US005947166A

United States Patent [19]

Doyle et al.

[11] Patent Number: 5,947,166

[45] Date of Patent: Sep. 7, 1999

[54] WIRE TYING TOOL WITH DRIVE MECHANISM

[75] Inventors: Graeme John Doyle, Edwards; Bramwell Cone, Vail; E. Jack Little, Longmont, all of Colo.

[73] Assignee: Talon Industries, Vail, Colo.

[21] Appl. No.: 08/814,154

[22] Filed: Mar. 10, 1997

Related U.S. Application Data

[63] Continuation of application No. 08/488,129, Jun. 7, 1995, abandoned, which is a continuation-in-part of application No. 08/265,576, Jun. 24, 1994, abandoned.

[51] Int. Cl.[6] ..... B21F 15/04

[52] U.S. Cl. ..... 140/119; 140/93.6; 140/57

[58] Field of Search ..... 140/54, 57, 93 A, 140/93.2, 93.6, 119

[56] References Cited

U.S. PATENT DOCUMENTS

| | | | |
|---|---|---|---|
| 2,214,267 | 9/1940 | Bednarek | 140/119 |
| 2,451,531 | 10/1948 | Bradley | 140/119 |
| 2,687,752 | 8/1954 | Diggs | 140/119 |
| 2,945,514 | 7/1960 | Wyss | 140/93 R |
| 3,391,715 | 7/1968 | Thompson | 140/93.6 |
| 3,593,759 | 7/1971 | Wooge | 120/118 |
| 4,117,872 | 10/1978 | Gött et al. | 140/57 |
| 4,354,535 | 10/1982 | Powell et al. | 140/93 |
| 4,362,192 | 12/1982 | Furlong et al. | 140/93.6 |
| 4,508,030 | 4/1985 | Grenon | 140/119 |
| 4,542,773 | 9/1985 | Lafon | 140/93.6 |
| 4,685,493 | 8/1987 | Yuguchi | 140/119 |
| 4,834,148 | 5/1989 | Muguruma et al. | 140/119 |
| 4,953,598 | 9/1990 | McCavey | 140/57 |
| 5,178,195 | 1/1993 | Glaus et al. | 140/119 |
| 5,217,049 | 6/1993 | Forsyth | 140/93.6 |
| 5,279,336 | 1/1994 | Kusakari et al. | 140/57 |
| 5,323,816 | 6/1994 | Hoyaukin | 140/119 |
| 5,431,196 | 7/1995 | Forrester, Jr. et al. | 140/93.6 |

*Primary Examiner*—Lowell A. Larson
*Attorney, Agent, or Firm*—Fitch, Even, Tabin & Flannery

[57] ABSTRACT

A wire tying tool having a set of movable talons for channeling a loop of hard wire around a rebar joint or other object(s) to be tied with a wire knot at high speed; a heavy duty wire drive with a pullback feature to retract the loop under tension to tighten the loop around the joint; a clutch-controlled retractable reel to hold the tension on the hard wire on the reel; a spinner/cutter that extrudes a knot by turning, kinking, and cutting the wire (holding the cut ends under tension) and then spinning in complete revolutions to twist the wire into a knot while drawing the spinner away from the work surface. In a preferred embodiment a single reversible motor powers each of a wire drive, a talon drive and a spinner drive; logic and control elements control a sequence of operations of the various drives.

46 Claims, 19 Drawing Sheets

WIRE TYING TOOL WITH DRIVE MECHANISM

This application is a continuation of application Ser. No. 08/488,129 filed on Jun. 07, 1995, now abandoned, which application is a continuation-in-part of application Ser. No. 08/265,576, filed Jun. 24, 1994, now abandoned.

FIELD OF THE INVENTION

The present invention relates to a wire tying tool, and more particularly to a portable, power assisted tool for binding rebar to be used in reinforced concrete, or for binding other object(s) with twisted wire.

BACKGROUND OF THE INVENTION

Concrete is a commonly used building material. Forms are fashioned and concrete is poured into the forms to harden, and then the forms are removed. To reinforce the concrete, a grid of metal "rebar" rods may be placed within the forms so that when the concrete hardens, it is strengthened by the rebar. The grid can be formed by a set of horizontal rebar rods which intersects with a set of vertical rebar rods. To hold the rebar grid in place, it is common to tie off the cross joints of the intersecting horizontal and vertical bars with a wire. This is a time-consuming process when done by hand, using standard 16 gauge annealed wire (about 67,000 psi).

A conventional hand tie, using pliers or similar tool, involves looping a strand of wire over a cross joint and pulling it tight so that the loop tightly encloses the joint with the ends of the wire twisted off to prevent unraveling. Two complete twists of 360 degrees each will hold the tie in place. Sometimes the wire is doubled to prevent the wire from breaking at the tie/twist point.

Because the tied joint has to hold while concrete is subsequently poured over it into the form, and may also (when the rebar is preassembled off-site) have to hold securely while the rebar grid is lifted, moved, stepped on, and handled, the wire tie must be tight and strong. Because of the difficulties associated with hand tying, it would be desirable to develop a light weight, portable, and reliable mechanical wire-tying tool.

A desirable mechanical wire-tying tool should be able to:

(a) loop a strand of wire over the joint to be tied—for this purpose a movable set of talons may be used with the talons placed over the joint and closed, the wire fed through the talons, and the wire then released from the talons so as to form a loop over the joint;

(b) cut and twist the ends of the wire looped over the joint—for this purpose a spinner/cutter may be used to cut the ends of the wire loop, to hold the loop under tension, and to twist the ends so as to form a "knot" without breaking the wire before the knot is formed, and drawing out the cut off ends of the wire loop as the knot is formed to leave the tie in place;

(c) pull back the slack on the ends of the loop after it is placed over the joint and then keep the loop under tension as the ends are twisted and the knot is being formed so as to form a tight knot—for this purpose, some sort of pullback mechanism and tension device should be used; and (d) feed a hard wire through the device without misfeeding through the talons or otherwise—for this purpose, a heavy duty wire drive mechanism should be used, and other portions of the device should be designed so as to cooperate in order to handle a hard wire delivered at high speed.

A desirable mechanical wire tying machine should be able to accomplish all of the foregoing functions rapidly and reliably with a hard wire, and should be capable of being operated by a single person. Prior art mechanical wire tying tools have not been completely satisfactory in meeting all of the desired features.

U.S. Pat. No. 3,391,715 of Thompson and U.S. Pat. No. 5,217,049 of Forsyth show wire tying devices having talons that are movable; cutters that include clamps with shear-plates (a shear disk); and feeding systems with a standard, paired wheel friction drive. Pullback is accomplished by reversing the drive wheels.

Other variations on a device having a talon, and including shear disk cutters (or a moveable disk cutter or a single blade "loper"), conventional feeding systems such as standard paired wheel friction devices, or drive wheel reversal for pullback are shown in U.S. Pat. No. 4,362,192 of Furlong et al.; U.S. Pat. No. 4,117,872 of Gott et al.(double wire system with talons that are channeled and not fully enclosed); U.S. Pat. No. 4,354,535 of Powell et al. (open groove); U.S. Pat. No. 4,685,493 of Yuguchi; U.S. Pat. No. 4,953,598 of McCavey (single hook, open groove); and U.S. Pat. No. 4,834,148 of Muguruma et al. (open groove with semi-enclosing member).

U.S. Pat. No. 4,542,773 of Lafon describes a wire tying machine with two lower jaws. Hand powered wire tie machines are shown in U.S. Pat. No. 5,178,195 of Glaus et al. and U.S. Pat. No. 3,593,759 of Wooge.

A principal disadvantage of current mechanical wire tying devices is their inability reliably to replace hand tying. The wire often misfeeds through the talons. The ends of the looped wire are frequently not twisted under tension sufficient to create a tight knot, and/or the knot breaks as it is being spun. The feed systems may not support a rapid advancement of a relatively hard wire, nor do the pullback or spools take up the wire.

It can be seen that there is a need for a reliable mechanically assisted wire tying tool. Preferably, the tool would include enclosed or partially enclosed talons for channeling a loop of relatively hard wire around a rebar joint at high speed, a pullback feature to retract the loop under tension to tighten the loop around the joint, a spinner/cutter that extrudes a knot by turning, kinking, and cutting the wire (holding the cut ends under tension) and then spinning in complete revolutions to twist the wire into a knot while drawing the spinner away from the work surface (so as not to break the knot as it is being formed), and a reset control to immediately reset the tool for the next tie.

The complete cycle should be completed in the space of about 2 to 3 seconds. The tool should be hand held and driven by electricity or compressed air. It should weigh around 15 to 20 pounds, be about 18 to 24 inches long, and about 4 to 6 inches in diameter. The tool should be able to improve upon the standard 16 gauge annealed wire rated at approximately 67,000 psi and which is commonly used in hand tied knots, by handling, instead, a much harder wire, such as a 16 gauge "green" (nonannealed) hard wire rated above 67,000 psi and up to approximately 127,000 psi, or greater.

It is a specific object of the wire tying apparatus and method of this invention to provide those benefits of reliability and performance which will permit a power tool to replace hand tying.

SUMMARY OF THE INVENTION

The present invention provides an apparatus and method for tying a wire knot around an object. A preferred use for the invention is tying a wire knot around rebar, but many other uses for the invention also exist, e.g., tying a wire knot around a fence post, a sack of potatoes or a bag of ice, or any other object, or combination of objects, around which a wire knot is needed or desired. The apparatus of the invention comprises a power assisted wire-knot tying tool. In the preferred embodiment, the tool is hand held and driven by electrical power, although battery power or compressed air could also be used. The tool weighs under 20 pounds (not including spool and wire), and is about 18 inches long, and about 4 to 6 inches in diameter. The preferred tool is designed to take a hard wire such as a 16 gauge "green" nonannealed hard wire (up to approximately 127,000 psi or more).

The wire tying tool of the invention includes a set of movable enclosed talons for channeling a loop of relatively hard wire around a rebar joint at high speed; a clutched, spring actuated retractable reel to hold the tension on the hard wire on the reel; a spinner/cutter that extrudes a knot by kinking and cutting the wire (holding the cut ends under tension) and then spinning in complete revolutions to twist the wire into a knot while drawing the spinner away from the work surface (so as not to break the knot as it is being formed); and a reset control to immediately reset the tool for the next tie.

In a preferred embodiment, the wire tying tool also includes a single reversible power source, e.g., an electric motor, which transmits power to three drive mechanisms including (i) a talon drive to close the talons around the joint to be tied, and then to reopen the talons; (ii) a spinner drive to advance and subsequently to retract a spinner shaft, turning and retracting the spinner after wire has been fed through the closed talons and a wire loop has been tightened around the joint, thereby spinning and extruding the knot; and (iii) a heavy duty wire drive to feed the wire into the talons and through openings on a spinner head attached to the spinner shaft, and then to retract the wire loop under tension to tighten the loop around the joint. It is to be understood that the invention is not restricted to an electric motor. Any suitable power source, or combination of power sources, may be used, e.g., a pnuematic motor(s), a hydrolic driver(s), an internal combusition engine (e.g., gasoline engine), and the like, coupled to a suitable energy source, e.g., 110/220 VAC power line, a battery, a source of compressed air, or the like.

In the preferred embodiment, the drive mechanisms incorporate a system of overload clutches, differentials, gears and mechanical logic such that the various drive mechanisms open the talons, close the talons, feed the wire through the talons and the spinner head, pull the loop, spin the knot, cut the wire, and reset the talons to the open position with but a single pull on the trigger which powers the motor.

An operator simply places the open talons over the rebar joint (or other object or objects around which the wire knot is to be tied) and presses the trigger. Activation of the trigger first transmits power to the talon drive and spinner drive. This closes the talons around the joint, forming a completely enclosed loop while advancing the spinner head to its fully forward position for receiving a length of wire. When the talons have fully closed and the spinner is locked forward, a mechanism will direct the power to the wire drive, and the wire drive will force a given length of wire through a first passage in a spinner/cutter assembly about the spinner head, around the talon loop, and back through a second passage in the spinner/cutter assembly with the end of the wire lodging through a non-return device (the excess wire through the clamp becomes waste and will be pushed out and expelled in the next cycle).

A mechanism is set to detect when the wire has reached the non-return device at the end of the loop, and the motor is reversed. The talon drive begins to pull back and the talons begin to open as the wire drive pulls back on the wire with full force, pulling the loop out of the talons and tightening the loop as it is released from the talons and pulled around the joint. The wire drive pulls the wire back under a preset tension (anywhere from 5 pounds or less of tension, to 150 pounds or more of tension) and tightens the loop around the rebar. The slack wire is reeled back automatically onto the spool.

When the wire drive has pulled the wire loop tight and the talon drive has opened the talons, power is redirected to the spinner drive and the spinner/cutter is activated. The spinner begins turning, kinks and cuts the wire, and turns a number of revolutions to twist the wire into a tie. As the spinner begins turning, shaped indentations in the spinner barrel form kinks in the wire lodged within the spinner head, and as the spinner continues to turn, a cutter cuts the wire lodged within the spinner barrel leaving the kinks at the cut ends. The kinks formed at the cut ends of the wire then pull through the passageways within the spinner so as to maintain the wire under tension after it is cut. The spinner retracts from the work surface as it spins, and does so at a rate equivalent to the length of the tie it is producing as it turns, thereby extruding the knot away from the work surface. The tool is then at a ready position, and the operator can move to the next tie point.

The combination of features provided by the invention permits the mechanical wire tying tool to replace hand tying in a reliable, fast and efficient manner.

BRIEF DESCRIPTION OF THE DRAWINGS

The above and other features and advantages of the invention will be more apparent from the following more particular description thereof presented in conjunction with the following drawings, wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

In the discussion which follows, the invention will be described from two different perspectives.

First, and with reference to FIGS. 1 through 12, the wire tying tool will be shown in a first embodiment with an emphasis on the most basic way in which the tool works—this will serve to explain how the spinner/cutter assembly spins and extrudes a knot, and how the wire drive and talons cooperate with the spinner/cutter. This discussion will serve as an introduction to the subsequent discussion of a second embodiment of the wire tying tool in which a preferred drive mechanism will be described.

Second, and with reference to FIGS. 13 through 32, the tool will be shown in a second embodiment and the drive mechanism will be explained in much greater detail—this will serve to explain how a single motor can power the three drives (talon drive, spinner drive, and wire drive) with associated clutches, differentials, gearings and mechanical logic so that each of the subassemblies of the wire tying tool performs its function in the proper sequence.

The first embodiment will be described under the heading "First Embodiment (Basic Operations)." The second embodiment will be explained under the heading "Second Embodiment (Drive Mechanism)." Although there is much in common between the two embodiments, each should be understood on its own. To emphasize the differences as well as the similarities, different sets of reference numbers have been used for the two embodiments.

FIRST EMBODIMENT

Basic Operations

Figure 1:
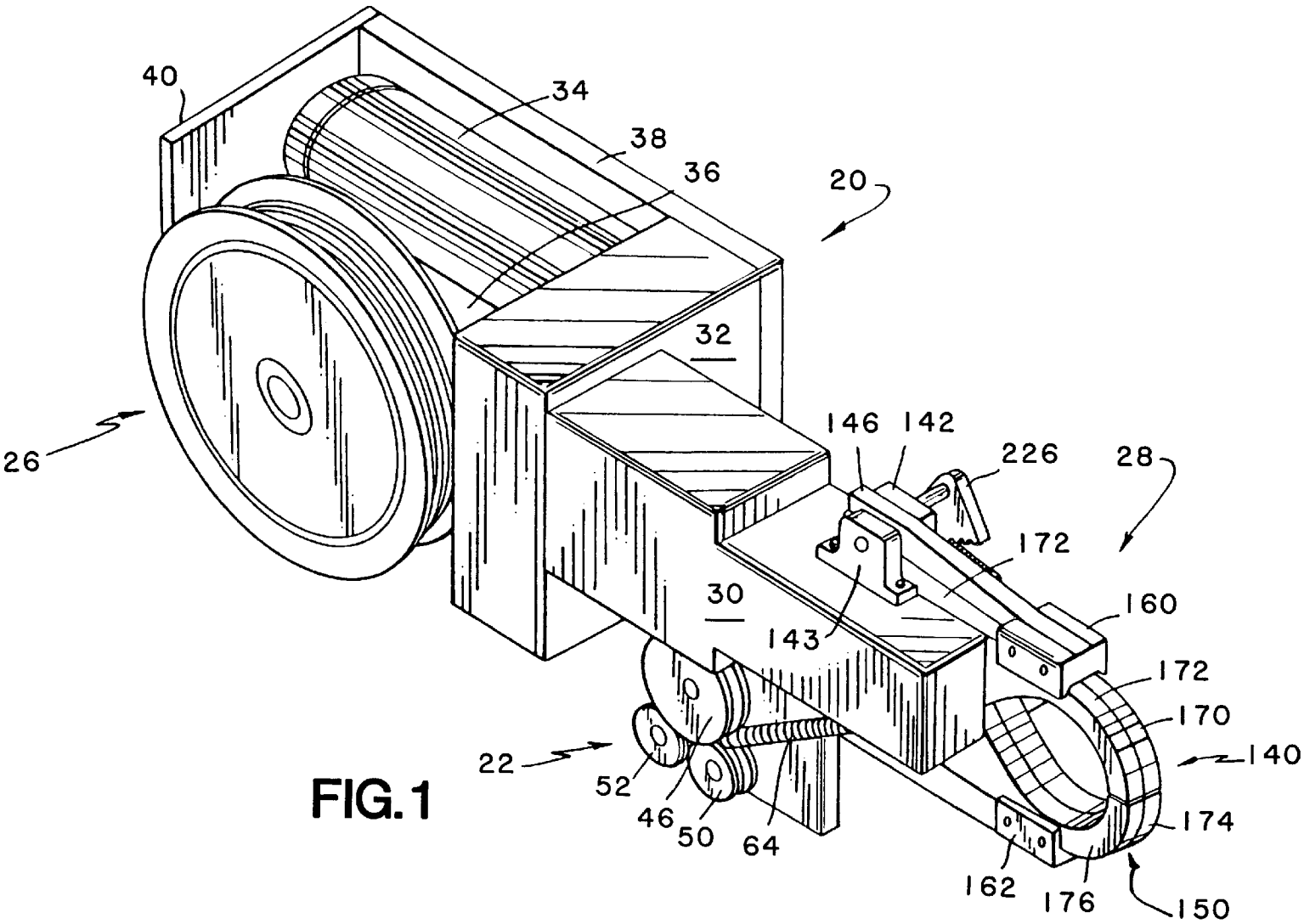
FIG. 1 is a perspective view of a first embodiment of the tool showing several of the subassemblies of the wire tying tool of this invention.

With reference to the perspective view of FIG. 1, it may be understood that a first embodiment of the wire tying tool 20 of this invention includes a wire drive and pullback assembly 22; a spinner/cutter assembly 24 (carried within the bearing block 30, and not visible in FIG. 1); a retractable reel or spool assembly 26; and a talon assembly 28.

Figure 2:
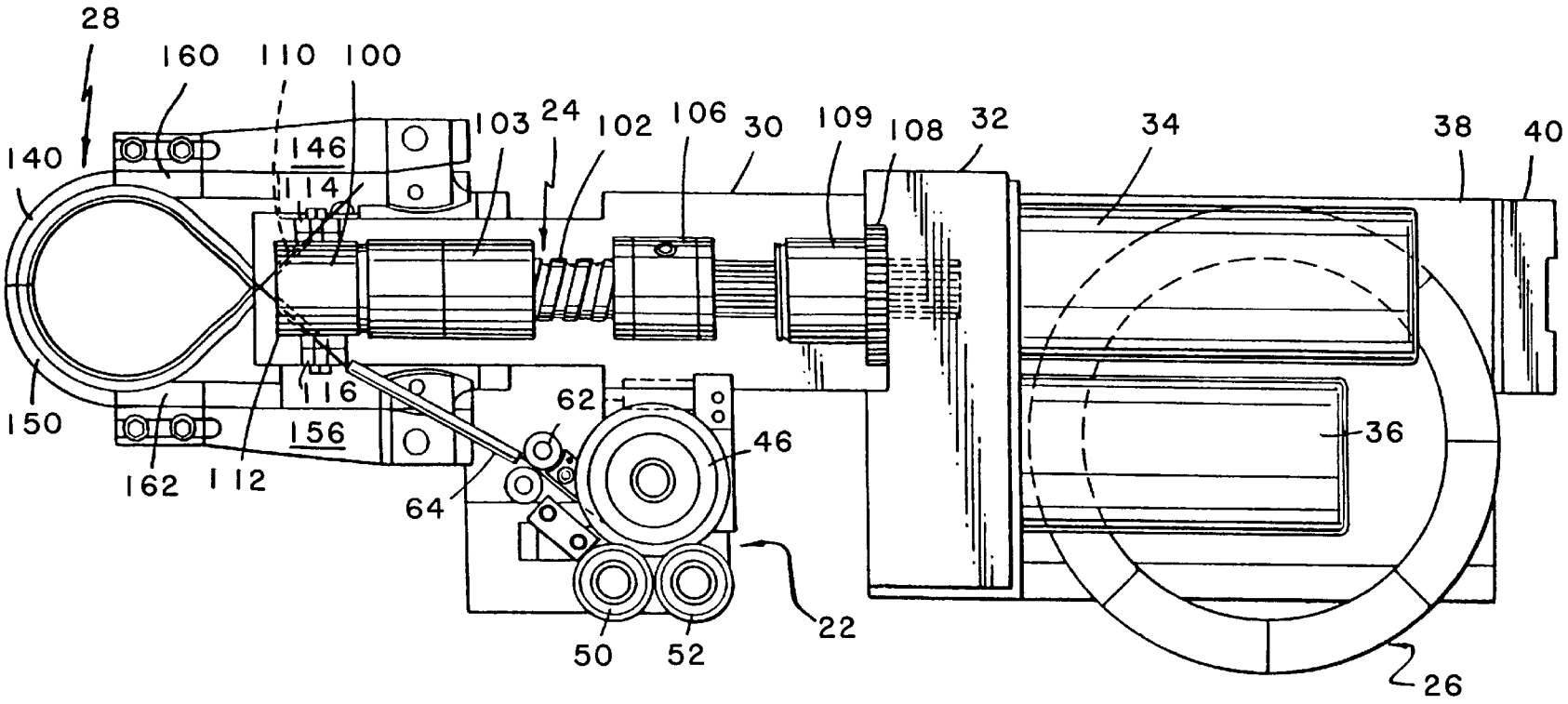
FIG. 2 is a schematic view of the wire tying tool of FIG. 1 of this invention.

Associated mounting, handling, power supply and control systems are also included and are indicated in FIG. 1 as bearing block 30, gearbox housing 32, spinner motor 34, feed drive motor 36, PC board 38, and handle support 40. With reference to FIGS. 1 and 2, it may be understood that the wire drive assembly 22 and talon assembly 28 are mounted on the bearing block 30, and that the spinner/cutter assembly 24 is carried within the bearing block.

The discussion which follows will describe each of the subassemblies in turn, and then describe how the subassemblies connect and cooperate with one another to achieve the objects of this invention.

The Wire Drive and Pullback Assembly

Figure 3:
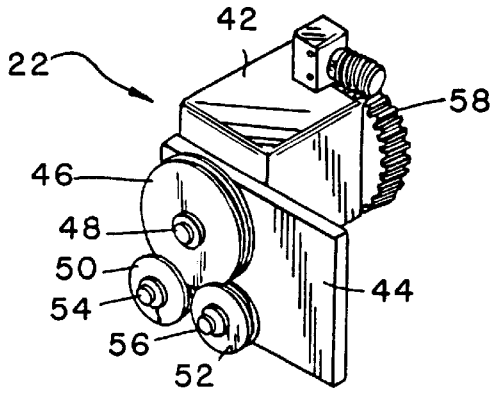
FIG. 3 is a perspective view of a wheel drive embodiment of the wire drive subassembly of the tool of FIG. 1.
Figure 3A:
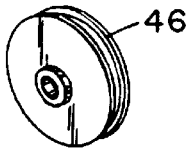
FIGS. 3A–3H are perspective views showing additional details of the subassembly of FIG. 3.
Figure 3B:
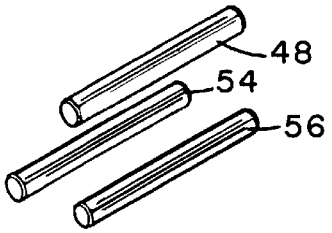
Figure 3C:
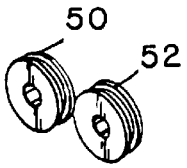
Figure 3D:
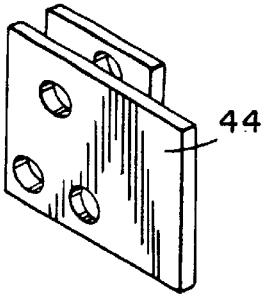
Figure 3E:
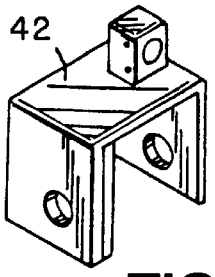
Figure 3F:
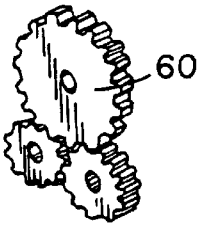
Figure 3G:
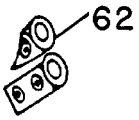
Figure 3H:
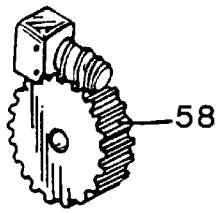

With reference to FIG. 3, and the more detailed views of FIGS. 3A to 3H, a first embodiment of the wire drive and pullback assembly 22 may be seen as a wheel drive. The assembly 22 includes a frame bracket 42 which is connected to the bearing block 30 (not shown in FIG. 3), and a pivot block 44 which is attached to the frame bracket.

A feed roller 46 is carried on feed roller shaft 48 carried on the pivot block 44 and frame bracket 42. Cooperating feed pinch rollers 50, 52 are carried on feed pinch roller shafts 54, 56 carried on the pivot block and frame bracket. A worm gear 58 transmits power from the feed drive motor 36 (not shown in FIG. 3) to feed roller shaft 48, and friction gears 60 cause the feed pinch roller shafts to move in concert with the feed roller shaft. It can be understood that the wire will feed between the feed roller 46 and the feed pinch rollers 50, 52. In a preferred embodiment, the contact surfaces of those rollers are grooved and are given a rough texture to better grip the wire. Such texture may be imparted by sand blasting the surfaces. A stripper 62 is used for initial loading of the wire, lifting the wire from the grooves in the drive rollers and directing the wire into feed tube 64 (reference FIGS. 1 and 2).

Figure 4:
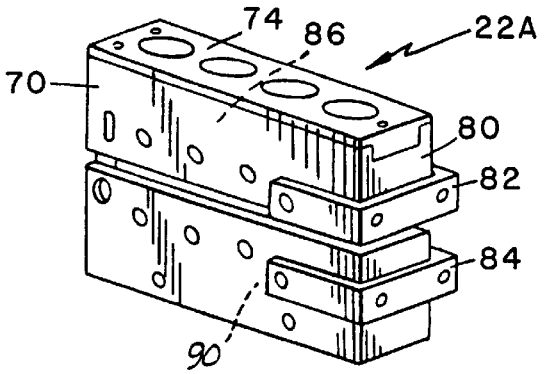
FIG. 4 is an exploded perspective view of a belt drive embodiment of the wire drive subassembly of the tool of FIG. 1.
Figure 4A:
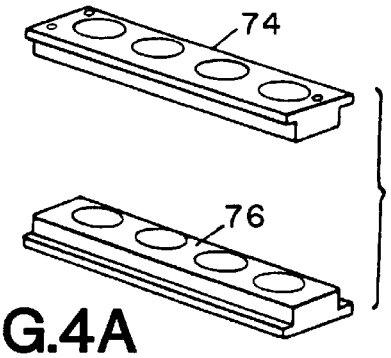
FIGS. 4A–4F are perspective views showing additional details of the subassembly of FIG. 4.
Figure 4B:
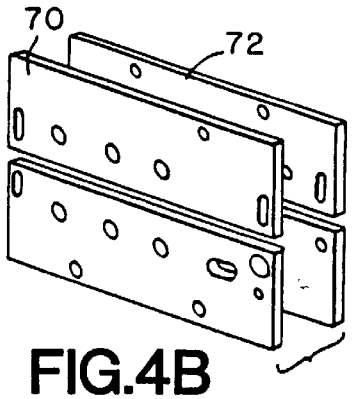
Figure 4C:
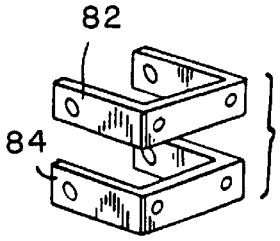
Figure 4D:
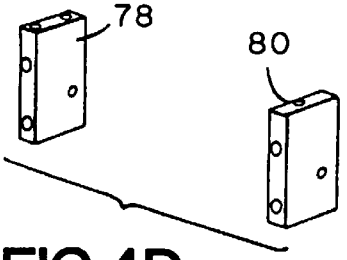
Figure 4E:
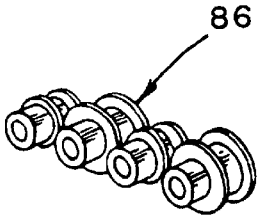
Figure 4F:
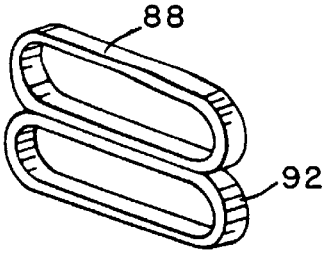

With reference to FIG. 4, and the more detailed views of FIGS. 4A to 4F, a second embodiment of the wire drive and pullback assembly 22A may be seen as a belt drive. The assembly 22A includes a frame which is connected to the bearing block 30 (not shown in FIG. 4) and which includes of a pair of side panels 70, 72, a top panel 74 and a bottom panel 76. The frame is completed by a pair of end panels 78, 80 and a pair of straps 82, 84.

A set of feeder pulleys 86 is carried between side panels 70, 72 and a feeder belt 88 is engaged on the pulleys. A cooperating set of feeder pinch rollers 90 is carried between the side panels and a pinch belt 92 is engaged on the rollers. Power from the feed drive motor 36 (not shown in FIG. 3) is transmitted to the feeder pulleys 86, and a tractor driven drive wheel drives the feeder belt 88 and pinch belt 92. It can be understood that the wire will feed between the belts. The feeder belts are given a friction surface; such a surface could be imparted by using a poly isoprene or other suitable material or coating.

The Spinner/Cutter Assembly

Figure 5:
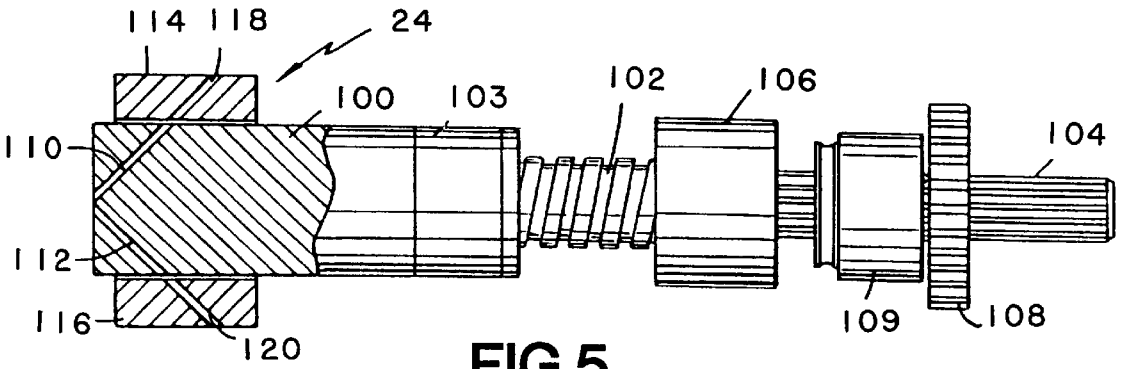
FIG. 5 is a partially cut away plan view of the spinner/cutter subassembly of the tool of FIG. 1.

With reference to FIG. 5, the spinner/cutter assembly 24 may be understood to include a cylindrical spinner head 100 axially affixed to a screw 102 which is in turn axially affixed to a spline 104. A screw collar 106 affixed to the bearing block 30 (not shown in FIG. 5) engages the screw 102, and a spline drive gear 108 transmits power from the spinner motor 34 (not shown in FIG. 5) to the spinner assembly. Bushings 109 and 103 guide the assembly within bearing block 30.

A first, or "entry" passage 112 and a second, or "exit" passage 110 are formed in the spinner head 100. While first passage 112 is referred to as the entry passage, and second passage 110 is referred to as the exit passage, it should be understood that these designations are for convenience of reference only and that the passages are essentially identical, and are bores passing diagonally through the spinner head 100, and are adapted for receiving the wire fed from the drive assembly 22. A pair of cutters 114, 116 are held in the barrel of the bearing block 30 adjacent the spinner head. Passages 118 and 120 formed within cutters 114, 116 are aligned with passages 110 and 112 so that wire may be fed through cutter 116 to the spinner head 100, and from the spinner head through cutter 114.

Figure 11:
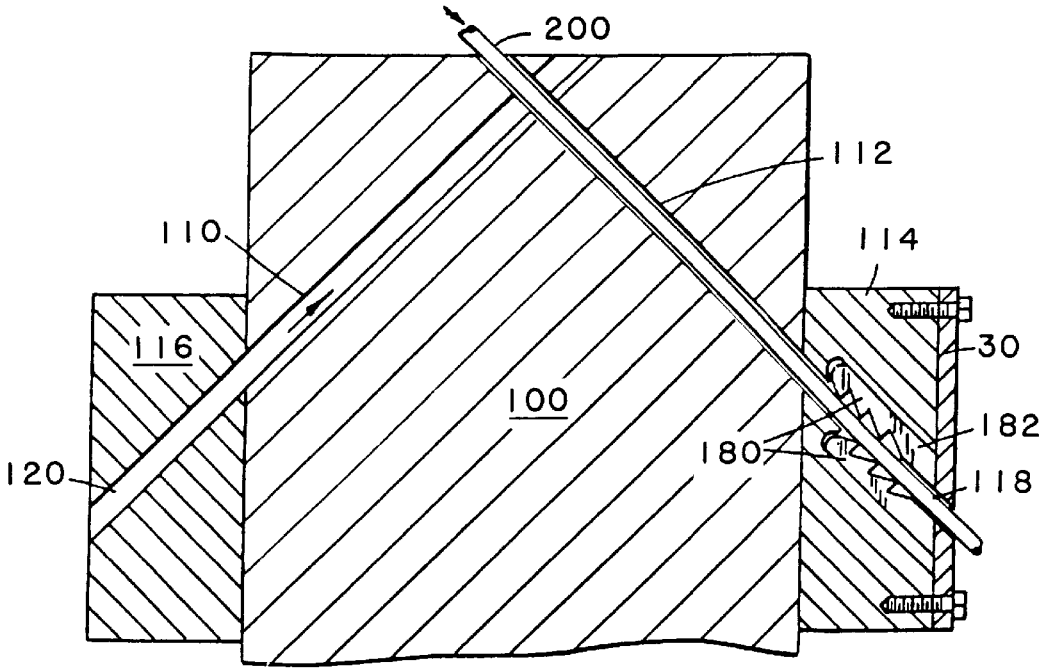
FIG. 11 is a plan view showing additional details of the spinner/cutter subassembly.
Figure 12:
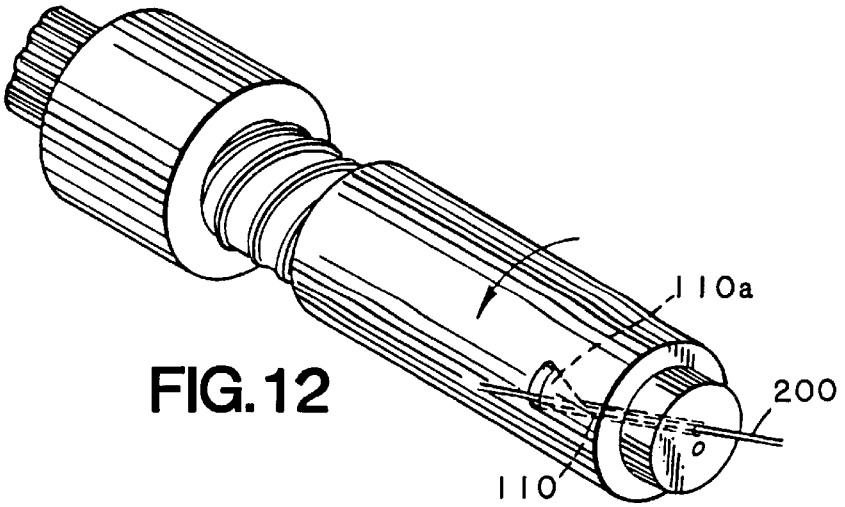
FIG. 12 is a perspective view showing additional details of the spinner.

Additional details of the spinner/cutter assembly may be understood with reference to FIG. 11 and FIG. 12.

With reference to FIG. 11, it may be seen that passage 118 of cutter 114 is fitted with a set of grippers 180 to form a non-return clamp 182. The grippers are mounted with spring plates to urge them against a wire 200, and the grippers have a series of ridges forming teeth opposed to the direction by which the wire enters passage 120. While a similar non-return clamp might be provided in cutter 116 as well, it should be remembered that cutter 114 is the cutter adjacent the exit passage 110 of spinner head 100, and a non-return clamp in cutter 114 will serve to hold the wire that is fed through the assembly.

Figure 11A:
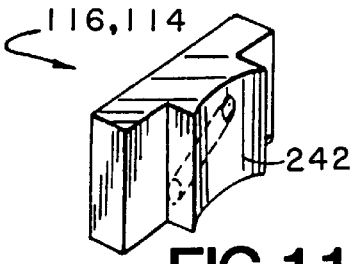
FIGS. 11A and 11B are perspective views showing additional details of the cutters of the embodiment of FIG. 1.
Figure 11B:
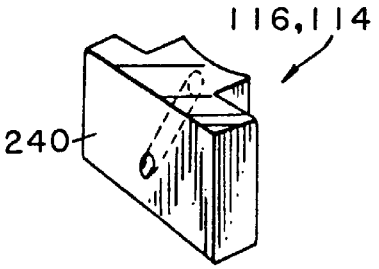

Cutters 116 and 114 are mounted within bearing block 30 (see FIG. 2) and flush against the spinner head 100. Cutters 116 and 114 may be seen to have a flat mounting side 240 (FIG. 11B) for mounting against the bearing block, and a curved surface 242 (FIG. 11A) that abuts the spinner head.

With reference to FIG. 12, it may be seen that there is a shaped indentation 110A within passage 110 of the spinner head. As shown in FIG. 12, shaped indentation 110A may be formed by widening the opening of passage 110 in an elliptical shape on the surface of spinner head 100. A corresponding shaped indentation 112A (not visible in FIG. 12) is formed in the same manner by widening the opening of tube 112 on the opposite surface of the spinner head.

The Talon Assembly

Figure 6:
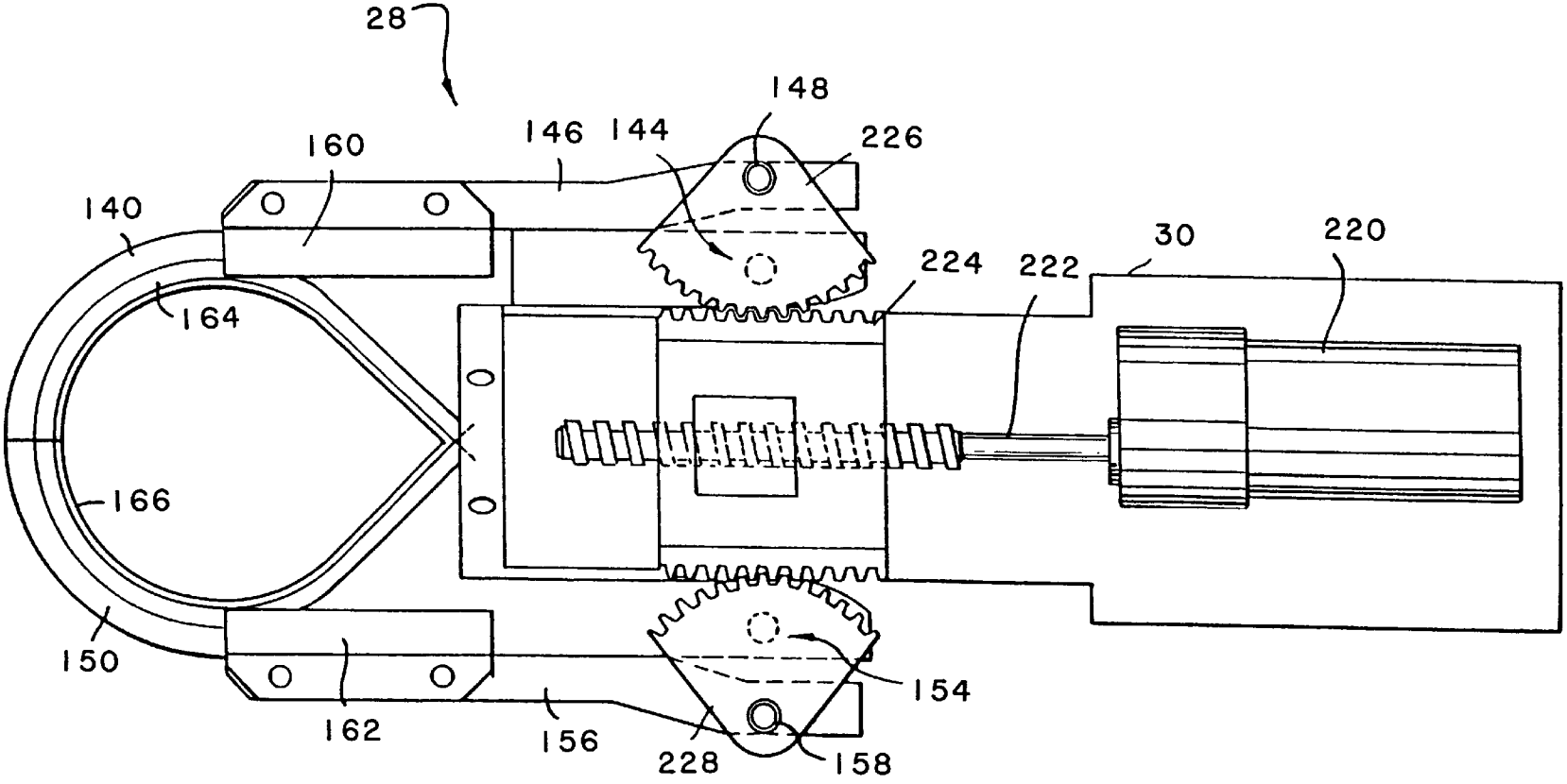
FIG. 6 is a top plan view of a first embodiment of the talon subassembly of this invention.

With reference to FIG. 6, the talon assembly 28 may be seen to include a first talon 140 set in talon mounting brackets 142 and 143 (reference FIGS. 1 and 8A) through pivot point 144, with the mounting brackets connected to the bearing block 30. A talon closer arm 146 pivots in mounting brackets 142, 143 and cooperates with talon closer 160 to effectively immobilize the first talon when engaged. A completely enclosed channel 164 within talon 140 can accept wire fed into it. (Note, throughout the description that follows, the term "jaw" may be used as a synonym for the term "talon").

Figure 8E:
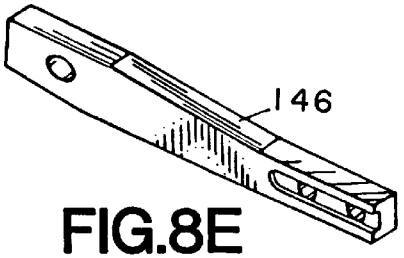
FIGS. 8A–8F are perspective views showing additional details of the subassembly of FIG. 8.
Figure 8D:
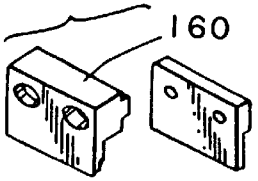
Figure 8C:
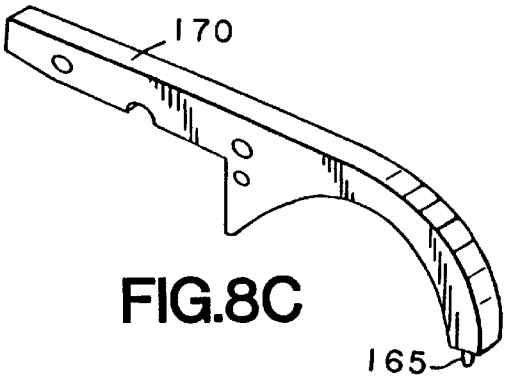
Figure 8:
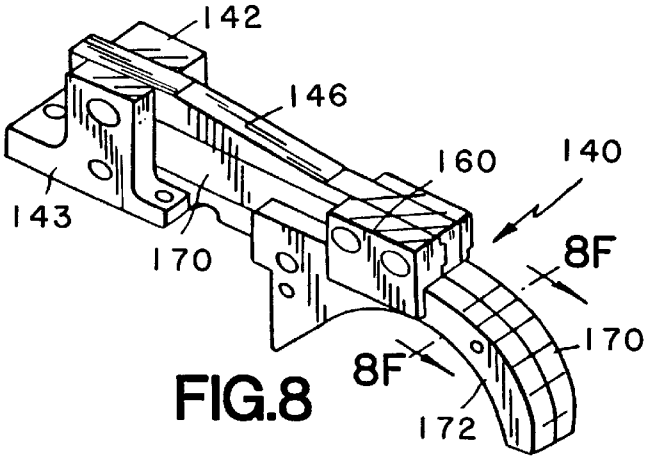
FIG. 8 is a perspective view of the talon arm, talon cover and other details of the talon subassembly.
Figure 8F:
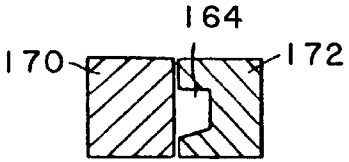
Figure 8A:
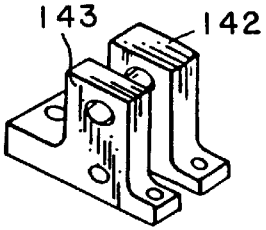
Figure 8B:
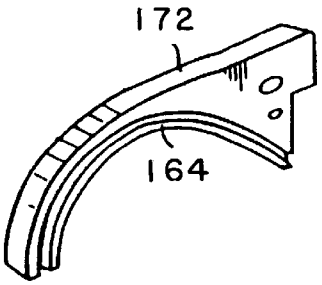

With reference now to FIG. 8, and more detailed views of FIGS. 8A to 8F, the talon 140 can be better understood to include a talon arm 170 and a talon cover 172. A channel 164 is formed in talon cover 172. When talon cover 172 meets talon arm 170, the two members cooperate completely to enclose channel 164.

A second talon 150 (referring again to FIG. 6) is set in talon mounting brackets 152 and 153 (not shown) through pivot point 154. A talon closer arm 156 pivots in mounting brackets 152, 153 and cooperates with talon closer 162 to effectively immobilize the second talon when engaged. A completely enclosed channel 166 within talon 150 can accept wire fed into it. Although not separately shown, a talon arm 174 and talon cover 176 form the enclosed channel 166 within second talon 150 in a manner corresponding to that of the first talon and as previously described with reference to FIG. 8.

The first and second talons 140, 150 meet when closed so that the enclosed channels 164, 166 align. A bullet nose 165 on talon arm 170 of the first talon 140 (reference FIG. 8C) mates with an indentation on talon arm 174 of the second talon 150 and helps to align the channels.

Figure 7:
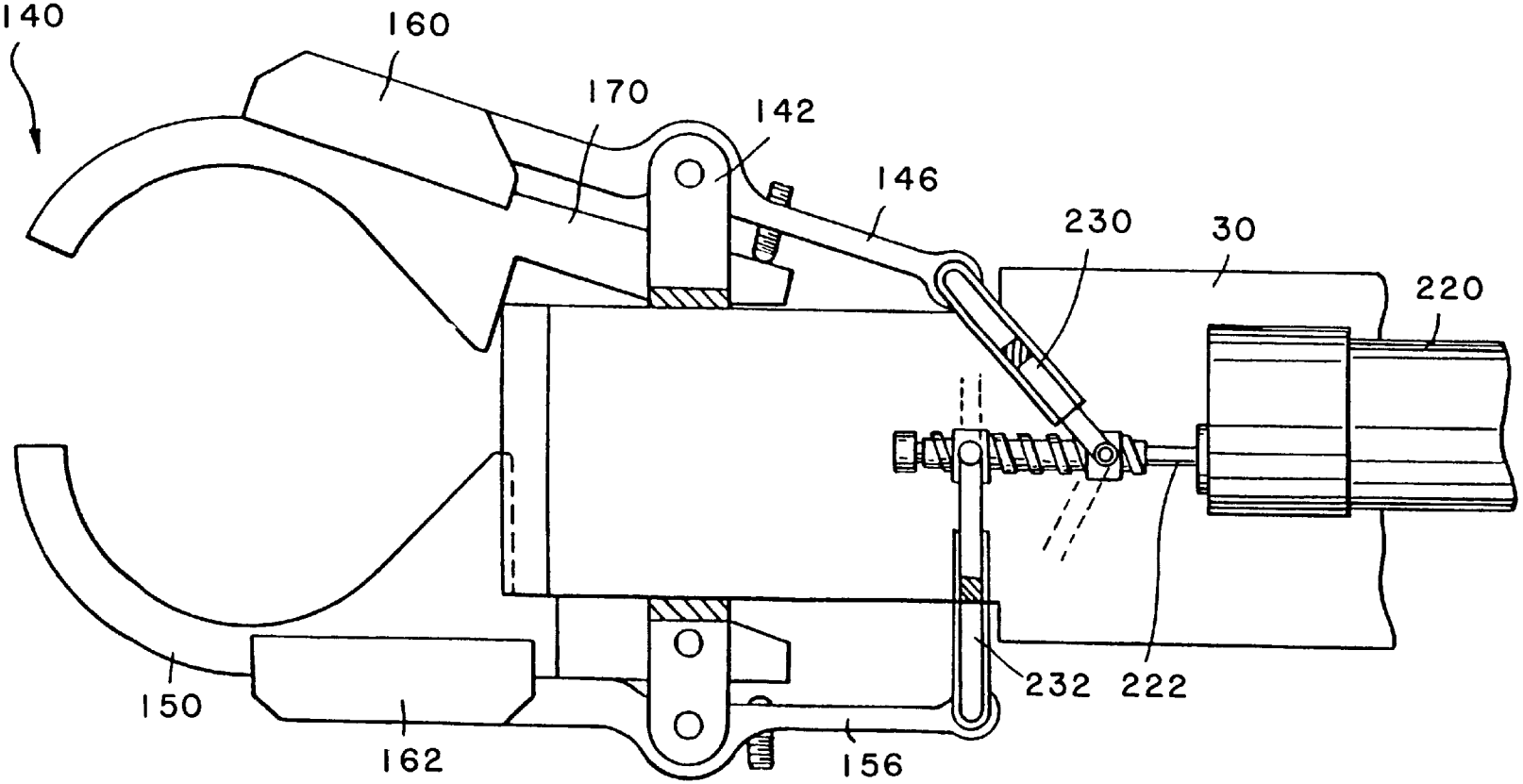
FIG. 7 is a top plan view of a second embodiment of the talon subassembly of this invention, and showing the cooperation of the talon arm and talon cover.

As shown in FIGS. 6 and 7, a talon motor 220 mounted on bearing block 30 powers a screw drive 222 for opening and closing the talons 140, 150. In the embodiment of FIG. 6, a worm drive translates the rotary motion from screw threads 224 to the flanges 226 and 228 which open and close the talon closer arms 146 and 156. In the embodiment of FIG. 7, a pair of tie rods 230, 232 connect screw 222 to talon closer arms 146 and 156 for opening and closing the talon closer arms.

In both embodiments, the talon closer arms 146 and 156 drive the talons 140 and 150 to a closed position. In the closed position, talon closers 160 and 162 hold the talon arm and talon cover of the talon arms tightly together to keep the channels enclosed (in the case of the first talon 140, as held closed by talon closer arm 146, talon closer 160 holds talon arm 170 and talon cover 172 tightly together so that channel 164 is enclosed; so also in the case of the second talon 150, as held closed by talon closer arm 156, talon closer 162 holds talon arm 174 and talon cover 176 tightly together so that channel 166 is enclosed).

Likewise, in both embodiments, as the talon closer arms 146 and 156 open, a gap will form between the talon closer arm and the respective talons 140 and 150, and the talon closers 160 and 162 will begin to release their hold on the respective talon arms (170 and 174 of the first and second talons) and talon covers (172 and 176 of the first and second talons), so as to open the space which previously enclosed channels 164 and 166. This creates a sufficient "break away" seam in the channels 164 and 166 so that a wire fed through the enclosed channels with the talons closed can break out of the (now partially opened) channels as the talons open.

The opening of the talons may be better understood with reference to FIG. 7, which shows talon 140 in an open position in comparison with talon 150 in a closed position (in actual operation, the two talons will open and close simultaneously, and the unworkable configuration of FIG. 7 with one talon open and the other talon closed is provided solely to illustrate both an open and a closed position of the talons).

The Retractable Spool

Figure 9A:
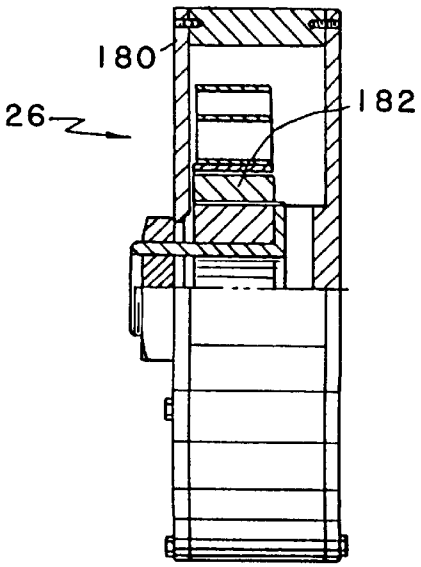
FIG. 9A is a front plan view thereof.
Figure 9:
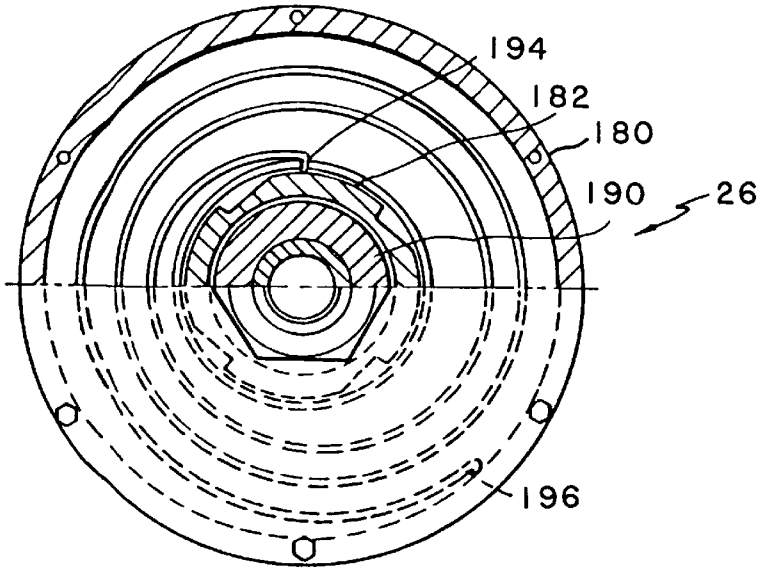
FIG. 9 is a partially cutaway plan view of the retractable reel or spool subassembly of this invention.

Referring now to FIGS. 9 and 9A, the retractable reel or spool assembly 26 may be understood to include a spring loaded spool 190 contained within spool housing 180. A spring 192 is wound from a first point 194 on the spool to a second point 196 to create a spring load. The spring load keeps the hard wire used in this invention from expanding on the spool, and also takes up any slack when the wire drive pulls back on the wire looped around the rebar joint to be tied. A one-way clutch 182 stops forward overrun of the spool and keeps tension on the wire.

The Wire Tying Tool

Having described each of the subassemblies, their cooperative working in wire tying tool 20 will now be described. Referring generally to FIG. 2, it may be understood that the talons have been closed around a rebar joint to be tied. With the talons closed, the wire drive and pullback assembly 22 draws a length of wire 200 from a spool of wire held in the retractable reel or spool assembly 26. The wire drawn by the wire drive and pullback assembly 22 is driven through tube 64, through cutter 116 of the spinner/cutter assembly 24 and through the entry passage 112 of the spinner head 100. Passing through the spinner head 100, the wire is driven through enclosed channels 164 and 166 of the talons 140 and 150, and back into the spinner head 100, passing through exit passage 110 of the spinner head and passing out through passage 118 of cutter 114 and through the non-return clamp 182 carried in cutter 114.

When the wire is through and the end is lodged in the non-return clamp, a mechanism opens the talons, allowing the previously enclosed channel to open (as discussed previously in connection with FIGS. 6, 7 and 8) and activates the pullback function of wire drive assembly 22. The wire drive assembly 22 pulls back against the wire with a preset tension (50 to 100 pounds) with one end of the wire firmly lodged in the non-return clamp. This pulls the wire loop from the channel within the talons and draws the loop tightly around the rebar joint.

Now with reference to the sequential series of views of FIGS. 10A, 10B, 10C and 10D, the operation of the spinner/cutter can be better understood.

Figure 10A:
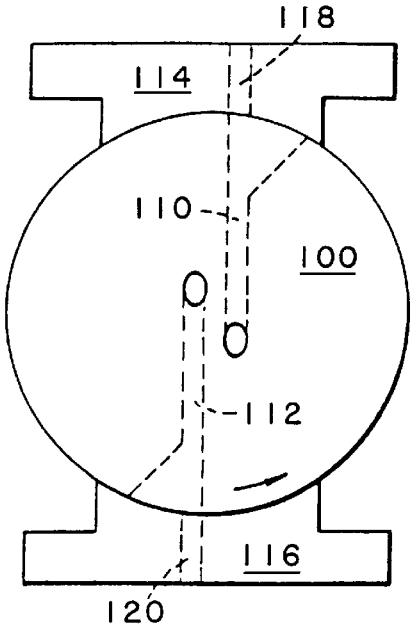
FIGS. 10A, 10B, 10C and 10D are a sequential series of front views of the spinner/cutter subassembly, showing the cutting and spinning sequence.

In the ready position of FIG. 10A, the spinner head 100 is aligned with the cutters 116 and 114 so that the entry and exit passages 112 and 110 of the spinner head align with passages 120 and 118 of the cutters.

Figure 10B:
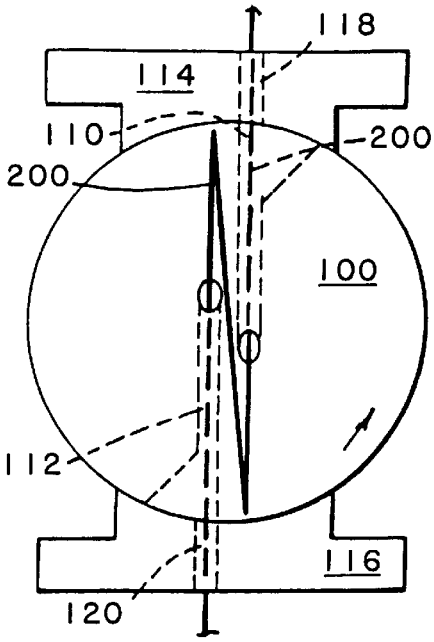

As can be seen in FIG. 10B, a length of wire 200 is fed through tube 120 of cutter 116, tube 112 of the spinner head 100 (and, after forming a loop through the talon arms, not shown in FIG. 10), tube 110 of the spinner head, and tube 118 of cutter 114. Wire 200 is lodged within the non-return clamp 182 (not shown in FIG. 10) of cutter 114.

Figure 10C:
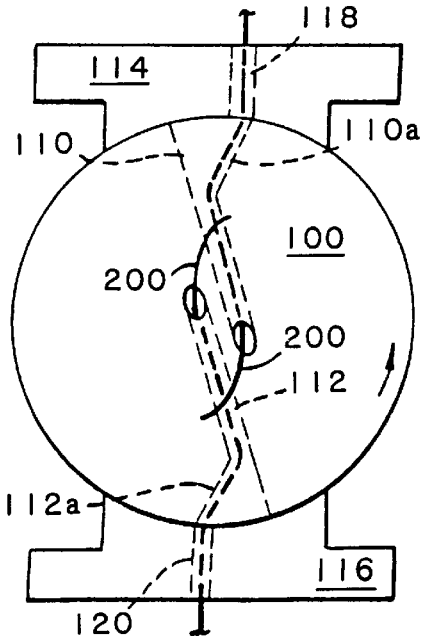

With reference to FIG. 10C, it can be understood that, after the loop is pulled back and tightened by the wire drive assembly (as previously discussed), and as the spinner begins to turn in a counterclockwise direction, one end of wire 200 is pushed into shaped indentation 110A in passage 110 and the other end of wire 200 is pushed into shaped indentation 112A of passage 112. This initial movement of the spinner head 100 forms a kink in each of the ends of wire 200.

Figure 10D:
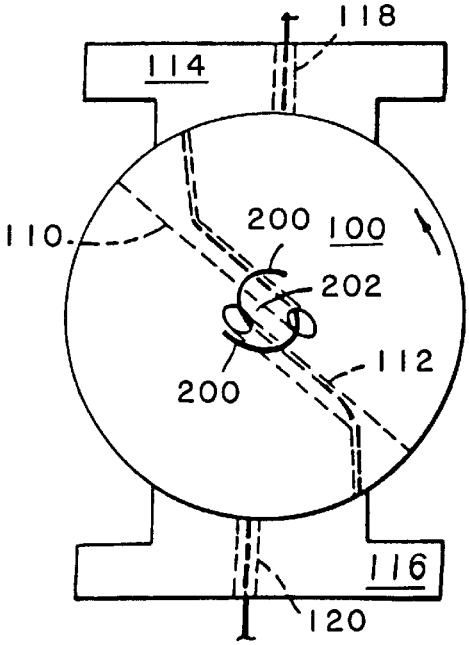

Next, and with reference to FIG. 10D, it may be understood that the two ends of wire 200 are cut by cutters 114 and 116 as the spinner continues to rotate. A twist knot 202 forms at the end of the wire loop adjacent to the spinner head 100. It may be understood that the knot 202 will continue to twist into place with further rotation of the spinner head, dragging the kinked ends of wire 200 through passages 110 and 112 of the spinner as it rotates. The kinked ends provide resistance within passages 110 and 112, keeping the wire loop under tension as the twist knot is formed.

The spinner head 100 extrudes the knot 202 away from the work surface of the rebar joint as the knot is being formed and as the kinked ends of the wire 200 are being drawn out of the spinner. This is accomplished by the cooperation of the screw 102 and collar 106 (reference FIGS. 2 and 5) which act to pull the spinner head 100 away from the work surface with each moment of rotation of the spinner head. A very precise movement can be achieved. Satisfactory results have been obtained using a screw pitch of ¼ inch, where four revolutions of the spinner extrudes a one-inch knot. By extruding the knot as it is being formed, the knot is much less likely to break off and ruin the twist/tie.

The associated triggers, motors, control devices, and the like are readily known in the industry and can be easily added to the above-described invention to complete the working thereof.

The foregoing description explains how the wire tying tool 20 of this invention forms a tight knot around a rebar joint, using a hard wire held under constant tension on a clutched-spool 26, a wire drive that sends a length of wire through a spinner/cutter assembly 24, looping around a completely enclosed track within talon assembly 28, and back through the spinner/cutter and through a non-return clamp where it is firmly lodged. More importantly, the foregoing description explains how the wire loop is tightened under tension supplied by the pullback of the drive assembly, how the length of wire is kinked and cut so as to maintain the tension in the loop as the knot is being formed, and how the knot is extruded from the spinner head as the spinner head withdraws from the work surface.

The method of this invention has been generally described in connection with the foregoing working of the tool, and includes: closing a pair of talons around a joint to be tied; driving a length of hard wire through a spinner/cutter, through a completely enclosed channel in the talons, and back through the spinner/cutter to a clamp; opening the talon channel so as to release the loop; pulling back on the loop to tighten it around the joint; and kinking, cutting, and twisting the wire so as to extrude a knot away from the joint while holding the loop under tension as the knot is being formed.

Accordingly, it can be understood that this invention provides the benefits of a tight and uniform wire tie, using a hard wire and replacing hand ties.

SECOND EMBODIMENT

Drive Mechanism

The first embodiment described above contemplates three motors, with a separate spinner motor (34), wire drive motor (36), and talon motor (220). The first embodiment also contemplated conventional electronic logic and control devices, as are well known in the field.

With reference now to the perspective view of FIG. 13, a second embodiment of the tool, having a single motor and a system of gears, latches, differentials and clutches will now be described. In this embodiment, the single motor will drive each of the spinner, the wire, and the talons in sequence. Thus, the single motor embodiment of FIG. 13 can be thought of as having a three-part drive mechanism, that is, a spinner drive, a talon drive, and a wire drive.

Figure 13:
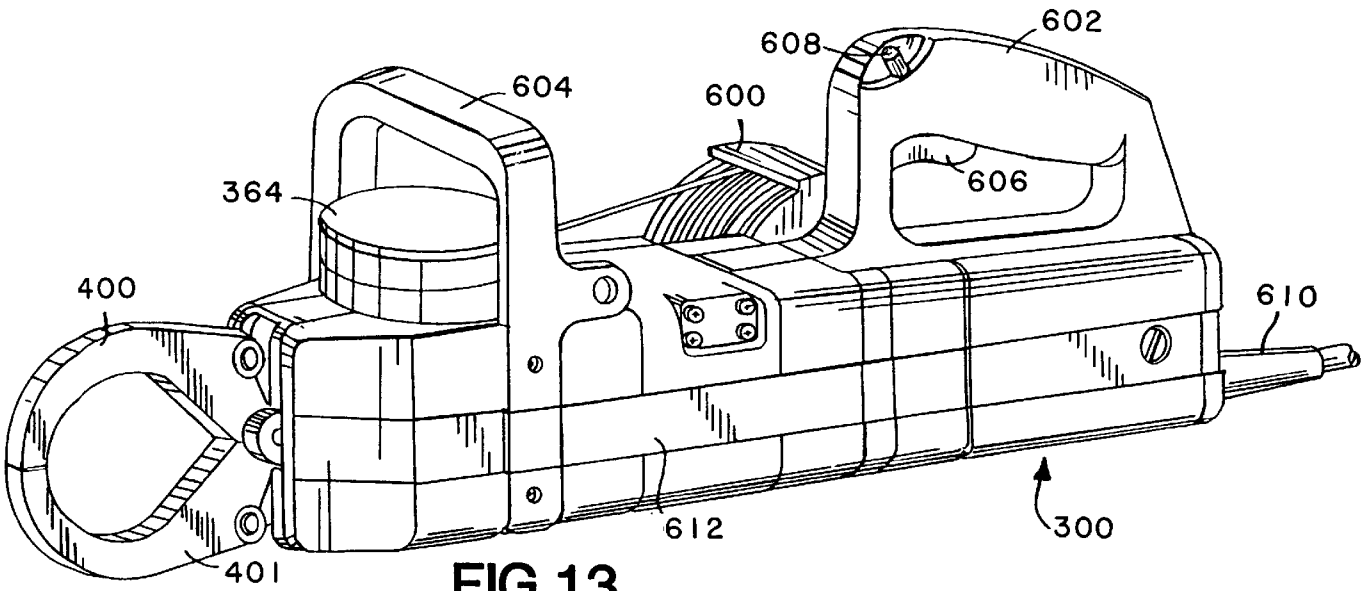
FIG. 13 is a perspective view of a second embodiment of the wire tying tool.

The discussion of the embodiment of FIG. 13 will include an overview, a glossary, and then a more detailed discussion which is organized around the three drives, followed by a discussion of the sequencing of the drives and the operation of the tool. Those three drives of the embodiment of FIG. 13 are generally described as follows (more detailed reference numerals in the related figures will be introduced subsequently):

Spinner Drive—The spinner drive actuates a spinner head by way of a spinner shaft. During the cycle of the tool, the spinner head first advances to a fully forward position and then forms knots by extruding the wire with rotary motion while retracting in a controlled manner.

Talon drive—The talon drive actuates the talons (or jaws) during the cycle of the tool, closing them at the beginning of the cycle to establish the wire path before the wire drive feeds the wire, and opening the talons (jaws) when the wire drive begins wire pullback.

Wire drive—The wire drive powers a capstan which pulls wire from the supply spool, pushes it through the talons, then reverses for "pullback"just before the knot is spun and extruded by the spinner drive.

These three drive functions are coordinated using mechanical logic to achieve the proper sequencing and drive flow during the cycle of the tool. A single reversible motor is used to power the tool and a small electronic control module is utilized to start, stop and reverse the motor at appropriate points during the cycle. In the overview, the action will be described as "forward" and "reverse," and the action will later be amplified in terms of the clockwise or counterclockwise rotation of the motor as transmitted to the various other driven shafts of the tool.

The overview will orient the reader to the three drives, their location within the tool, their general purposes and relationship to one another and to the single motor which powers all three. The glossary will then list most of the working elements of the three drive mechanisms. Because of the number of similarly functioning latches, detents, shafts, pins, springs, rollers and so on spread over three drive mechanisms, we have used distinguishing nomenclature which can be fairly lengthy. For example, we will describe a "wire lock release lever," and a "wire lock release inhibit lever," cooperating with such things as a "wire lock release inhibit lever cam pin" (350 in FIG. 26) and a "wire lock release tab" (352). We believe these terms to be helpful to an understanding of the invention. To help prevent confusion, we have provided a glossary of terms.

Overview. With reference to the perspective view of FIG. 13, it may be understood that this embodiment is not greatly different in external appearance from the embodiment of FIG. 1. A wire spool 600 may be seen at the right rear of the tool and a capstan 364 may be seen at the top of the tool, near the front. The wire drive will power the capstan to draw wire from the spool into the tool. Two talons, an upper talon 400 and a lower talon 401 are seen in a vertical orientation at the front of the tool. The talon drive will pull back on the talons to open them (and push forward to close them). It should be noted that, in this particular configuration, the talons will open and close in the vertical plane (up and down) and it should be apparent that the talons could have been oriented in any other position desired. The vertical orientation chosen here allows the talons to be conveniently placed over a joint to be tied. Two handles, a trigger handle 602 at the rear of the tool, and a support handle 604 near the front of the tool, are provided for operator control. The trigger handle contains a trigger 606 and a reverse button 608. The support handle 604 provides a convenient hand-hold for the operator to stabilize and support the tool. A long-handled version of the tool (see FIG. 30) extends the range of the tool, permitting the operator, for example, to stand more comfortably while setting ties near the operator's feet. The motor 300 (not visible in FIG. 13) is mounted in the rear of the tool and is powered through electric cord 610. Of course the tool could be powered by battery, hydraulic or other appropriate power source. For safety and other reasons, the tool is surrounded by an exterior housing 612 which keeps many of the moving parts of the drive mechanism out of the path of the operator's hands and otherwise shelters them from exposure. Other similarities, and differences, between the embodiment of FIG. 13 and the previously discussed embodiment of FIG. 1 will become more apparent as this description proceeds.

The embodiment of FIG. 13 includes three drives, a wire drive, talon drive, and spinner drive (not visible in FIG. 13, but to be shown later, with reference to other figures). In this embodiment, each of the three drives are driven by a single motor. Taking the perspective view of FIG. 13, it may be seen that the tool of this embodiment has a right side where the spool 600 is carried; a left side; a front (or "fore") part where the talons 400 and 401 are carried; a back (or "aft") part from whence the cord 610 exits; a top surface where the capstan 364 is carried; and a bottom surface. Given this frame of reference, the shafts of the various drives will be described as running "vertically" or "horizontally." A "vertical" shaft is one whose axis runs generally up and down, from the top to the bottom of the tool. A "horizontal" shaft is one whose axis runs generally parallel to a longitudinal axis of the tool, that is, from front to back.

One difficulty in presenting an overview of the tool of FIG. 13 is that there is no one view of the tool in which all of the three drive mechanisms and their associated drive shafts may be clearly seen and understood at once—various of the horizontal shafts overlay and obstruct a view of other shafts from any angle. But the understanding of the tool and of its drive mechanisms becomes straightforward once the orientation of the drives is seen with reference to the shafts that tend to define them, recognizing that this requires the cooperative viewing of several figures. In overview, each of the main shafts and drives will now be identified and located.

Figure 14:
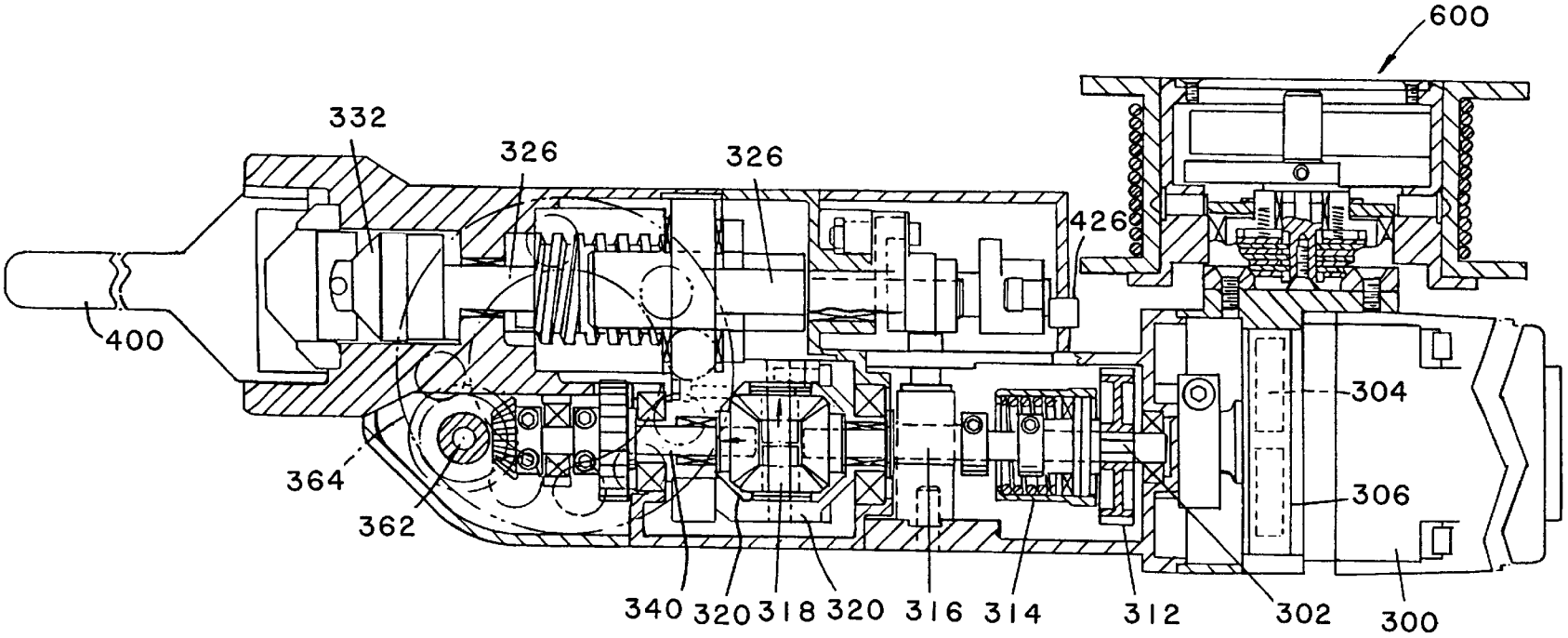
FIG. 14 is a top partially cutaway plan view of the embodiment of FIG. 13.
Figure 24:
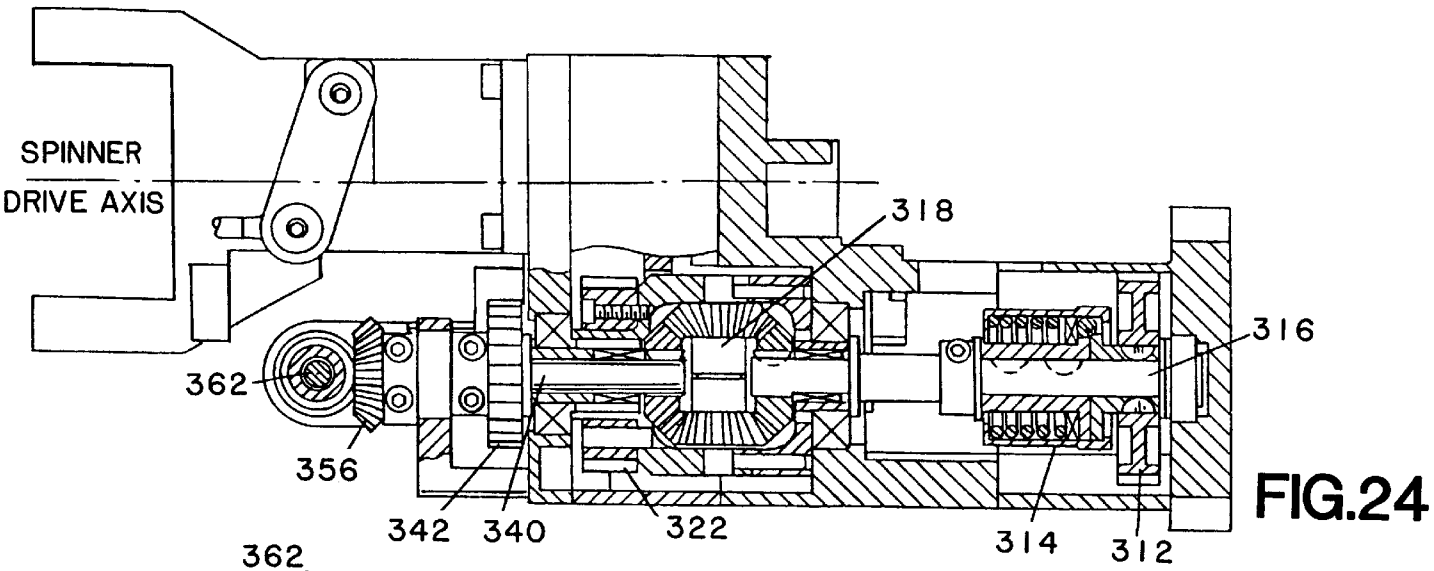
FIG. 24 is a partially cutaway bottom plan view showing the wire drive assembly of the embodiment of FIG. 13.
Figure 25:
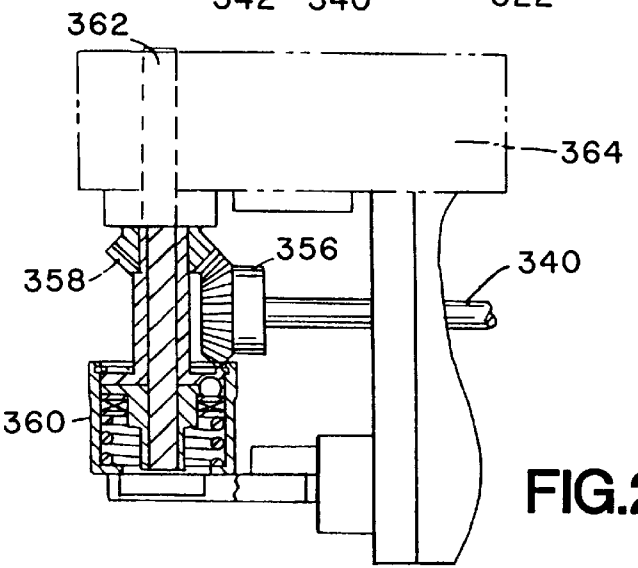
FIG. 25 is a partially cutaway side view showing a detail of the capstan of the embodiment of FIG. 13.
Figure 26B:
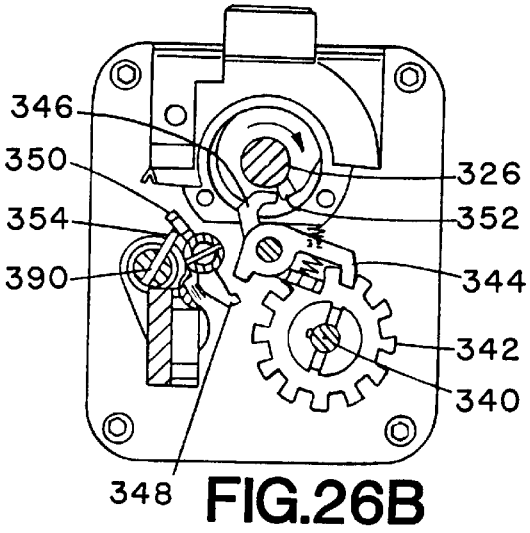
Figure 26C:
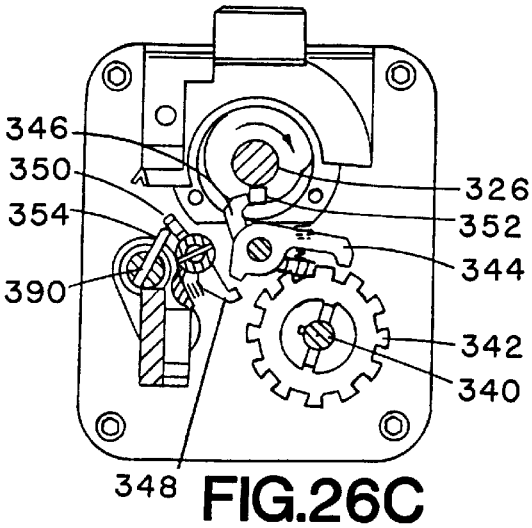

The wire drive ultimately powers the capstan 364 (FIG. 13) which, when running in the forward direction, will draw wire from the spool 600, feed the wire into the openings on the spinner head 332 (not visible in FIG. 13, but shown, e.g., in FIG. 20) and through the talons 400 and 401; and, when running in reverse, will pull back on the wire, pulling a loop about the joint to be tied. With reference to FIGS. 24 and 25, it may be understood that the wire drive itself includes a vertical shaft 362 and a horizontal shaft 340. In the discussion which follows, vertical shaft 362 will be referred to as the "capstan drive shaft" and horizontal shaft 340 will be referred to as the "differential output shaft" and other details will be shown and discussed. For present purposes, it is sufficient simply to note the horizontal and vertical axes of the wire drive, and to orient the wire drive within the tool. Referring to FIGS. 13, 14 and 24, it can be understood that the horizontal shaft 340 of the wire drive runs longitudinally within the housing 612, at the left side of the tool and near the top of the tool, and that the vertical shaft 362 of the wire drive is perpendicular to the horizontal shaft, extending up within the housing to the capstan 364, to which it will transmit power.

Figure 20:
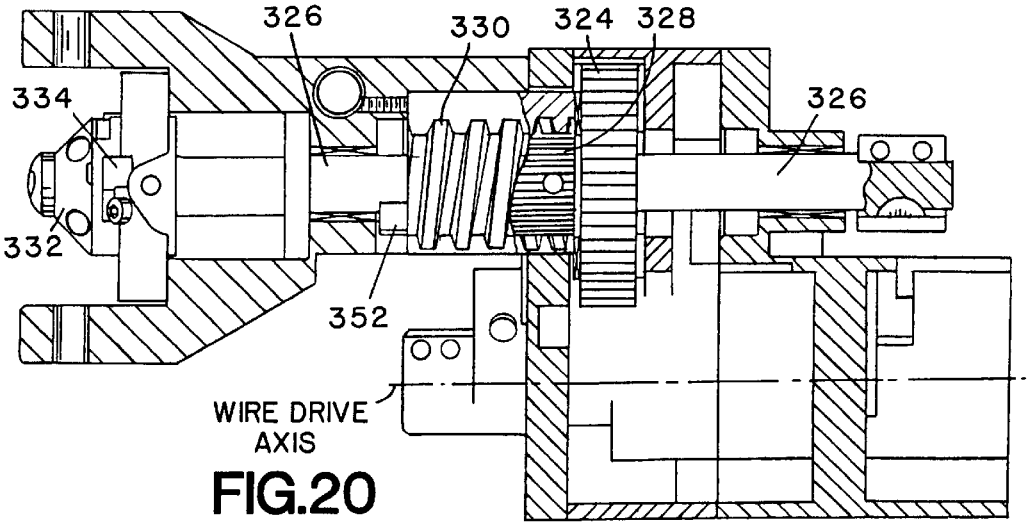
FIG. 20 is a partially cutaway bottom plan view showing details of the spinner drive of the embodiment of FIG. 13.

The spinner drive ultimately powers the spinner head 332 (FIG. 20) which, when running in the forward direction, will rotate and advance forward into a proper position at the front of the tool to receive the wire that will be fed by the wire drive into its openings; and, when running in reverse, will then rotate and retract, cutting the wire and spinning and extruding the knot. With reference to FIG. 20, it may be understood that the spinner drive includes a horizontal shaft 326. In the discussion which follows, this horizontal shaft 326 will be referred to as the "spinner shaft" and other details will be shown and discussed. For present purposes, and referring to FIGS. 13, 14 and 20, it is sufficient to observe that the horizontal shaft 326 of the spinner drive runs longitudinally within the housing 612, near the center bottom of the tool.

Figure 15:
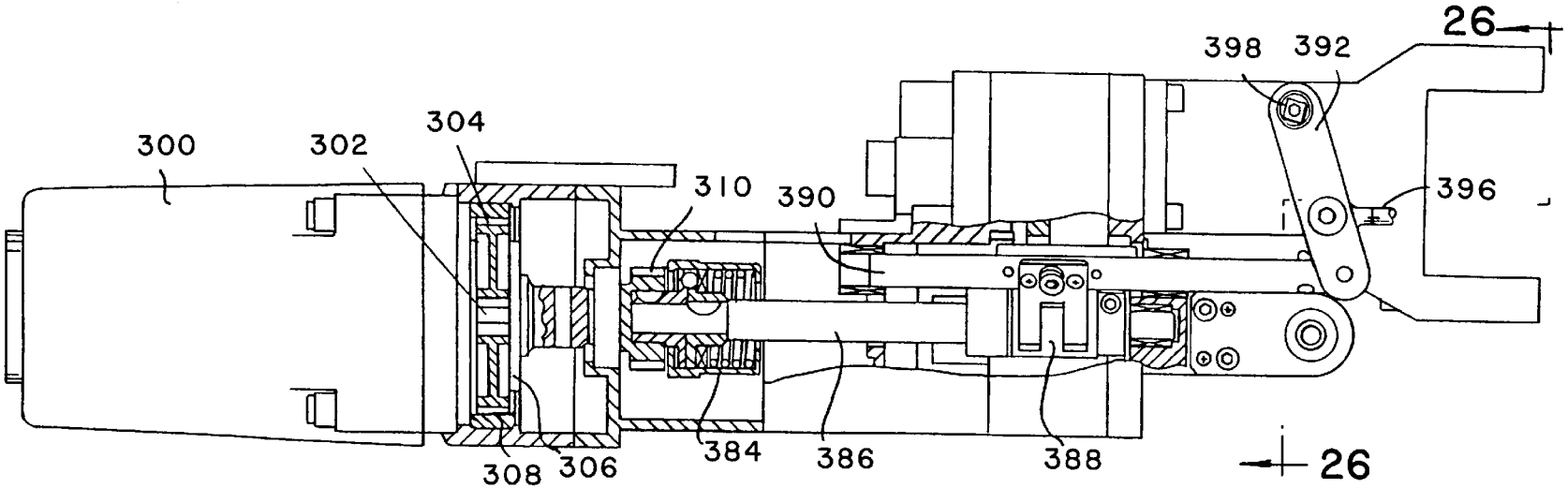
FIG. 15 is a bottom (mirrored) partially cutaway plan view showing details of the talon drive of the embodiment of FIG. 13.

The talon drive ultimately pushes a lever 392 (FIG. 15) at the bottom of the tool which, when the drive is running in the forward direction, will push the talons 400 and 401 (FIG. 13) closed, enclosing the joint to be tied, with the talons ready to receive the wire that will be fed by the wire drive into the channel within the talons; and, when running in reverse, will pull the talons open, releasing the wire loop around the joint to be tied. With reference to FIG. 15, it may be understood that the talon drive includes a horizontal shaft 386 and another horizontal member 390 connected to the shaft. In the discussion which follows, the horizontal shaft 386 of the talon drive will be referred to as the "talon lead screw shaft," the other horizontal member 390 will be referred to as the "talon pushrod," and other details will be shown and discussed. For now, and referring to FIGS. 13 and 15, it should be observed only that the horizontal shaft 386 of the talon drive runs longitudinally within the housing 612 near the bottom of the tool and on the right side.

Figure 26A:
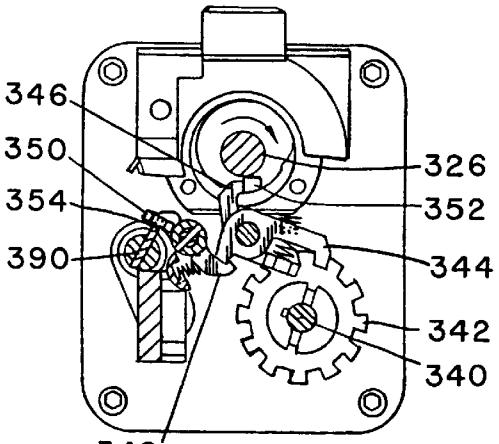
FIGS. 26A, B and C are a sequential series of front sectional views showing details of the mechanical logic of the embodiment of FIG. 13.
Figure 27:
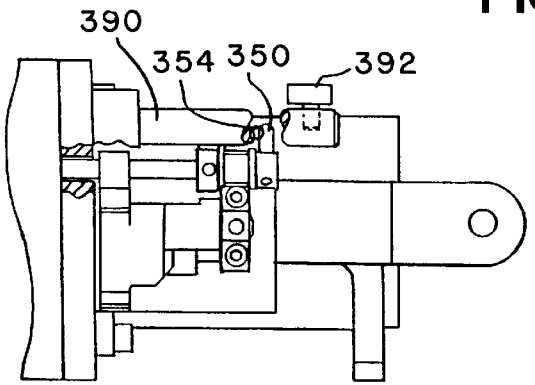
FIG. 27 is a side view showing details of the mechanical logic of the embodiment of FIG. 13.
Figure 16:
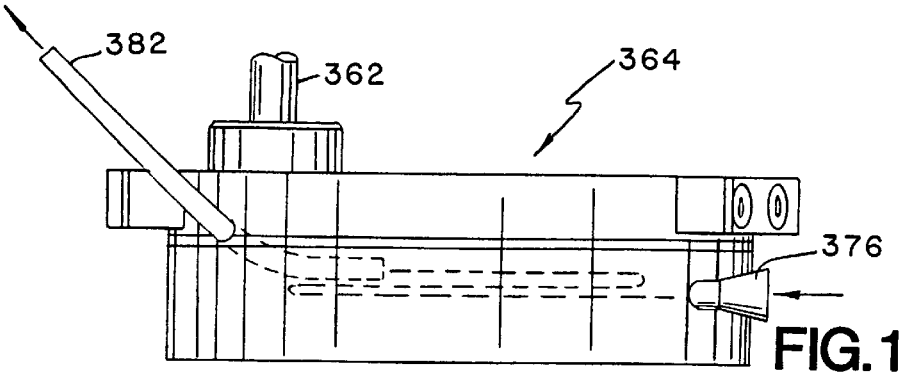
FIG. 16 is a side view of the capstan assembly of the embodiment of FIG. 13.

The orientation of the three horizontal shafts of the three respective drives may now be seen, in overview, with reference to FIG. 26A, which is a front sectional view of the tool. The horizontal shaft 340 of the wire drive may be seen at the left top; the horizontal shaft 326 of the spinner drive may be seen at the center bottom; and the talon pushrod 390 of the talon drive may be seen at the right side (the horizontal shaft 386 of the talon drive is adjacent the talon pushrod but cannot be seen in FIG. 26A).

Finally, and with reference to FIG. 14, one more horizontal shaft may be noticed, and that is the main shaft 316 driven by the motor 300. The main drive shaft 316 will be referred to as the the "differential input shaft" 316 for reasons which will become clear later.

Now it may be better understood how and why the sequencing of the drives is important to the proper working of the tool. Still with reference to FIG. 14, the talons 400, 401 should be closing while the spinner head 332 is advancing to the forward position: the talon drive and the spinner drive should move forward in tandem. The talons 400, 401 should be fully closed and the spinner head 332 fully forward before the wire drive feeds any wire: the capstan 364 of the wire drive should push the wire through only when the talon drive and the spinner drive are not moving their respective assemblies. The drives should go into reverse when the proper length of wire is fed and engaged. Working in reverse, the capstan 364 of the wire drive now pulls back on the wire, the talon drive opens the talon 400 and 401, and the spinner head 332 rotates and retracts.

This sequencing presents a problem for logic control, and the more detailed discussion which follows this overview is best understood in terms of explaining that control. Two final observations concerning the sequencing are pertinent in this overview.

In the first place, a key towards understanding the sequencing is the recognition that the motor 300, when triggered, powers two shafts simultaneously, and at all times. The two constantly powered shafts are (a) the differential input shaft 316 (reference FIG. 14) which is the source of power for the spinner drive and the wire drive, and (b) the talon lead screw shaft 386 (reference FIG. 15) which is the source of power for the talon drive. Each of these are clutched (main overload clutch 314 with reference to FIG. 14; and talon overload clutch 384 with reference to FIG. 15) so that power may be relieved and the shafts are not always driven, but the point is that both the differential input shaft 316 and the talon lead screw shaft 386 are always powered, and so both may run together, or separately.

Of these two constantly powered shafts, one, the talon lead screw shaft 386, directly transmits power to the talon drive and thus accounts for one of three drive systems (the talon lead screw shaft 386 is the horizontal shaft of the talon drive previously discussed in this overview).

The other of the two constantly powered shafts, the differential input shaft 316 (reference FIG. 14), accounts for the other two drive systems. The differential input shaft 316 feeds into a differential 318 which splits the power to the wire drive or to the spinner drive. The differential transmits power either to the wire drive, by way of the differential output shaft 340 (which is the horizontal shaft of the wire drive previously discussed in this overview) and capstan drive shaft 362 (which is the vertical shaft of the wire drive previously discussed in this overview); or to the spinner drive, by way of intermediate gears to spinner shaft 326 (which is the horizontal shaft of the spinner drive previously discussed in this overview). The wire drive is clutched (wire drive overload clutch 360 on the vertical shaft 362 of the wire drive, reference FIG. 25) and the spinner drive may be "detented" or locked so that the power is directed to one or the other of the spinner drive or the wire drive.

This arrangement of shafts, clutches and detents or locks permits the three drives to be combined as necessary. The tool is sequenced, at various points in the cycle, so that the talon drive and either the spinner drive or the wire drive are being driven—for example, and with reference to FIG. 14, the talon drive together with the spinner drive, so that the talons 400 and 401 close and the spinner head 332 advances while the wire drive is locked); so that either the spinner drive or wire drive, but not the talon drive, is being driven (for example, the wire drive alone, so that the capstan 364 feeds wire through the tool while both the talon drive and spinner drive are locked); and so on (various other combinations will be discussed further in the detailed description).

This leads to the second point to be made in this overview about the logic control system. The particular embodiment discussed herein is essentially a mechanical logic system rather than an electronic logic system. The mechanical logic was chosen for, among other reasons, its expected durability in an anticipated operating environment which may be dirty, muddy, cold or hot and otherwise potentially hostile. We believe that the mechanical logic design has allowed this wire tying tool to be fabricated as a heavy duty, reliable tool with industrial application. Accordingly, we believe that the mechanical logic example which is given herein is the better way of embodying our invention. It should be remembered, of course, that once our invention is understood, it is a simple design choice to incorporate its features in electronic logic instead of mechanical logic. The translation from mechanical to electronic logic is well known in the industry and it should be understood that this invention is suitable for either mechanical or electronic logic, and that this invention covers both applications.

Having completed this overview, a glossary of terms will now be presented.

Figure 17:
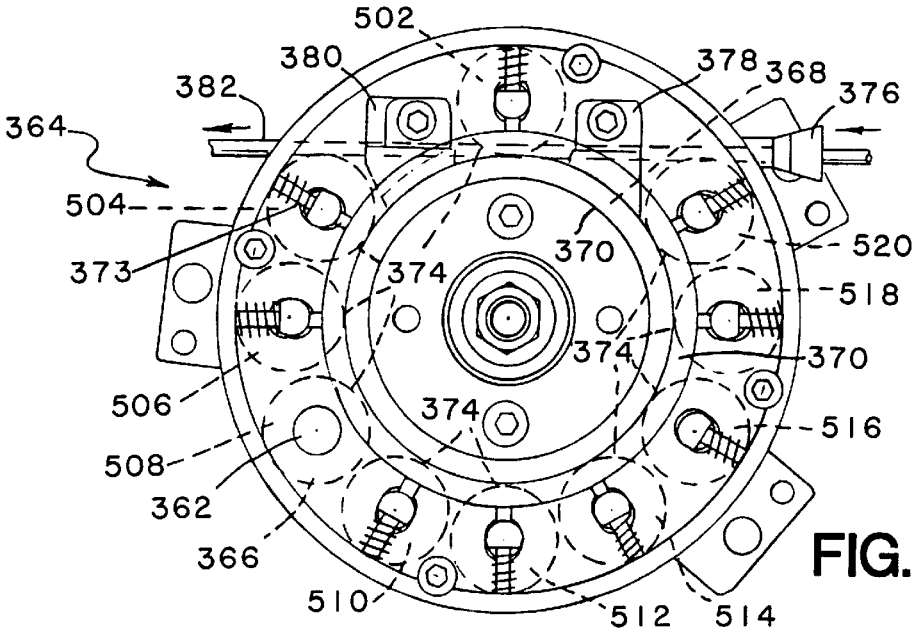
FIG. 17 is a top plan view of the capstan assembly of the embodiment of FIG. 13.
Figure 19:
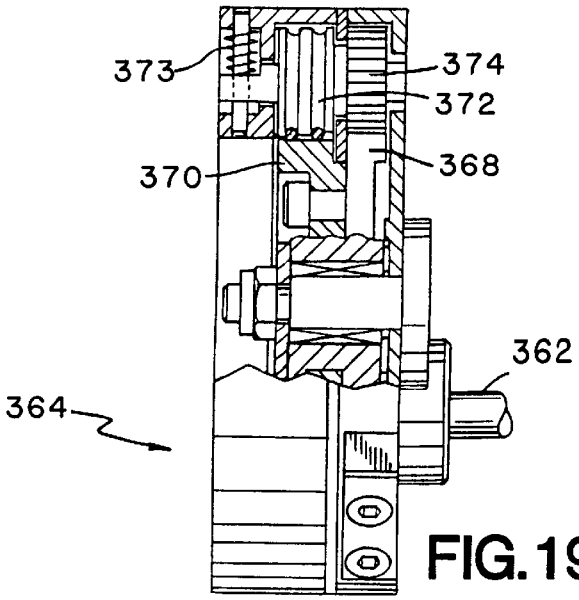
FIG. 19 is a partially cutaway side elevation view of the capstan assembly of the embodiment of FIG. 13.
Figure 21:
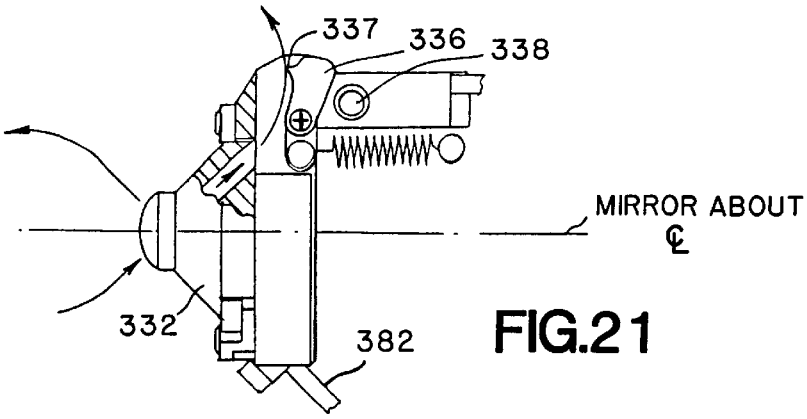
FIG. 21 is a partially cutaway bottom plan view showing a detail of the spinner head assembly of the embodiment of FIG. 13.

Glossary. Most of the components which are relevant to the operation and sequencing of the drive mechanisms of the tool are numbered and briefly defined in the list below (these components will be explained in more detail below, and will be more particularly pointed out with reference to the various drawings, this glossary is for the reader's aid only):

| Ref/FIG | Element | Description |
|---|---|---|
| 300 FIG. 14 | Drive Motor | The universal AC/DC reversible motor (approx. 1/4 to 1/3 HP) used to power the tool and having a motor shaft. |
| 301 | Motor Shaft | The shaft of motor 300 |
| 302 | Motor Pinion | The small diameter gear integral to the motor shaft of motor 300. |
| 304 | Planetary Gears | The two gears driven by the Motor Pinion 302. |
| 306 | Planetary Cage | The carrier for the Planetary Gears 304. |
| 308 | Ring Gear | The internal gear which the Planetary Gears 304 drive against. |
| 310 | Intermediate Pinion | The gear which is directly driven by the Planetary Cage 306. |
| 312 | Main Drive Gear | The gear driven by the Intermediate Pinion 310, which is the source of power for the Spinner Drive and the Wire Drive. |
| 314 | Main Overload Clutch | The torque limiting clutch directly driven by the Main Drive Gear 312. |
| 316 | Differential Input Shaft | The shaft directly driven by the Main Overload Clutch 314 which supplies power to the Differential. |
| 318 | Differential | The "power splitting" device which powers either the Spinner drive or the Wire drive. |
| 320 | Differential Cage | The outer structure of the Differential 318. |
| 322 FIG. 24 | Spinner Drive Pinion | The gear mounted to the Differential Cage 320 which powers the Spinner Drive by driving the Spinner Drive Gear 324. |
| 324 FIG. 20 | Spinner Drive Gear | The gear driven by the Spinner Drive Pinion 322 which provides rotation to the Spinner Shaft 326. |
| 326 | Spinner shaft | The shaft which provides rotation and linear movement to the Spinner Head 332. |
| 328 | Spinner Drive Spline | The spline which permits linear movement to the Spinner Shaft 326 while transmitting torque. |
| 330 | Spinner Drive Thread | The thread which causes linear movement of the Spinner Shaft 326 during rotation. |
| 332 | Spinner Head | The head which extrudes the knots after wire has been fed through and pulled back. |
| 334 | Cutter Blocks | The two blocks against which the wire ends are sheared when knots are extruded. |
| 336 FIG. 21 | Wire Sensor Toggle | The spring loaded rotating tab which cams and triggers the Wire Sensor 338 when the wire feeds through the Spinner Head 332 and which also locks the wire upon pullback. |
| 337 | Wire Sensor Toggle Tab | The tab on the Wire Sensor Toggle 336 in the wire path which actuates the toggle 336 and locks the wire. |
| 338 | Wire Sensor | The proximity switch which is triggered by the Wire Sensor Toggle 336. |
| 340 FIG. 14 | Differential Output Shaft | The shaft that transfers power from the Differential 318 to the Wire Drive. |
| 342 FIG. 26 | Wire Lock Wheel | The notched wheel that enables the wire drive to be locked when not being utilized. |
| 344 | Wire Lock Pawl | The swinging lever/tab that engages the Wire Lock Wheel 342. |
| 346 | Wire Lock Release Lever | The cammed lever that actuates the Wire Lock Pawl 344 via a compression spring. |
| 348 | Wire Lock Release Inhibit Lever | The cammed lever that inhibits the Wire Lock Pawl 344 from disengaging the Wire Lock Wheel 342. |
| 350 | Wire Lock Release Inhibit Lever Cam Pin | The pin that actuates the Wire Lock Release Inhibit Lever 348 (carried on the opposite arm of 348). |
| 352 | Wire Lock Release Tab | The tab rotating with the Spinner Shaft 326 that actuates Wire Lock Release lever 346. |
| 354 | Wire Lock Release Inhibit Lever Cam | The cam located on the Talon Push Rod 390 which actuates the Wire Lock Release Inhibit Lever Cam Pin 350. |
| 356 FIG. 24 | Wire Drive Driver Miter Gear | The miter gear mounted on the end of the Differential Output Shaft 340 which supplies power to the Wire Drive by driving the Miter Gear 358. |
| 358 FIG. 25 | Wire Drive Driven Miter Gear | The miter gear that is driven by the Wire Drive Driver Miter Gear 356 and which is directly coupled to the Wire Drive Overload Clutch 360. |
| 360 | Wire Drive Overload Clutch | The torque limiting clutch that supplies power to the Capstan Drive Shaft 362. |
| 362 | Capstan Drive Shaft | The shaft that transmits power to the Capstan 364. |
| 364 FIG. 13 | Capstan | The drive module that feeds and pulls back the wire during the cycle of the tool. |
| 366 FIG. 17 | Capstan Drive Pinion | The gear keyed to the Capstan Drive Shaft 362 which drives the Capstan Sun Gear 368. |
| 368 | Capstan Sun Gear | The large gear inside the Capstan 364 which directly drives the Capstan Drum 370. |
| 370 | Capstan Drum | The smooth steel drum around which the wire wraps during its passage through the Capstan 364. |
| 372 FIG. 19 | Capstan Rollers | The grooved, spring loaded rollers which surround the Capstan Drum 370. |
| 373 | Capstan Roller Preload Springs | The springs that push inward towards the center of the capstan to load the Capstan Rollers 372 against the Capstan |

-continued

Figure 22:
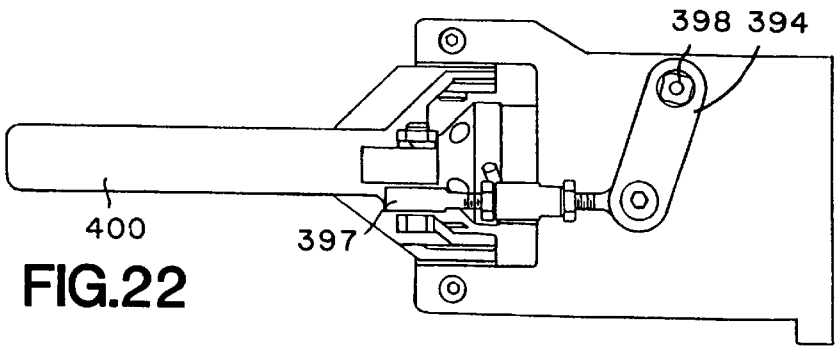
FIG. 22 is a top view showing details of the talon assembly of the embodiment of FIG. 13.
Figure 23:
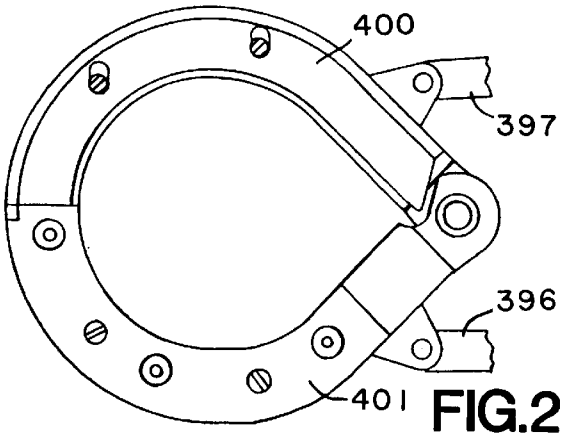
FIG. 23 is a side view showing details of the talon assembly of the embodiment of FIG. 13.
Figure 31:
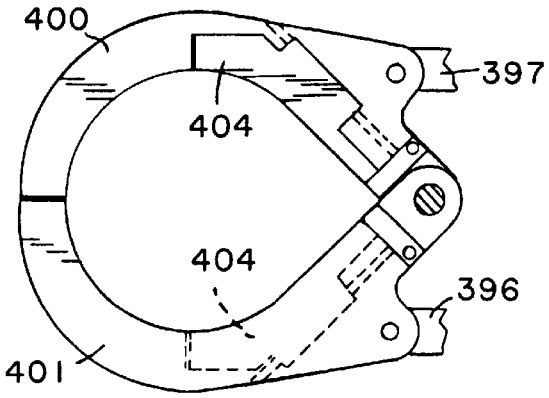
FIG. 31 is a side view showing details of the talon assembly of the embodiment of FIG. 13.
Figure 28:
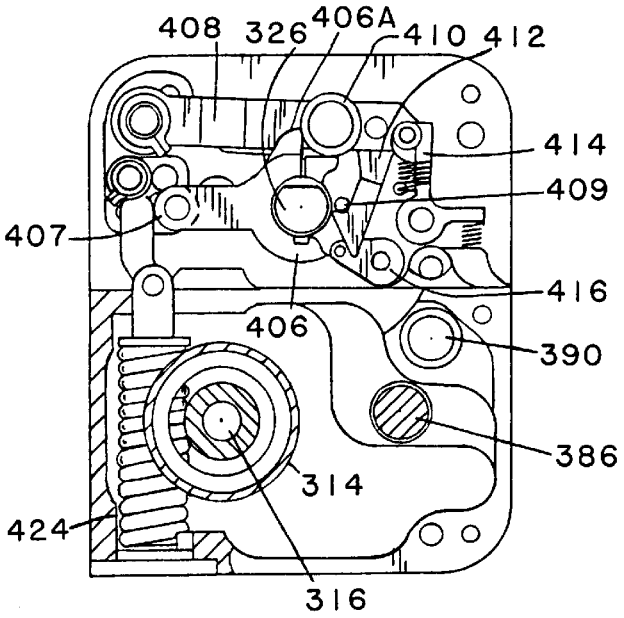
FIG. 28 is a front sectional view showing details of the mechanical logic of the embodiment of FIG. 13.
Figure 29A:
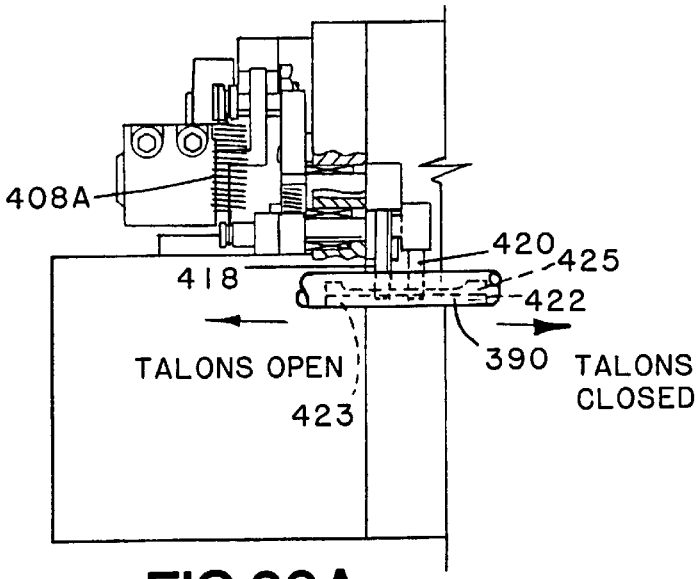
FIG. 29A is a a partially cutaway side view showing details of the mechanical logic of the embodiment of FIG. 13.
Figure 29B:
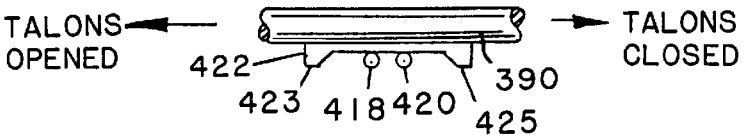
FIG. 29B is a top plan view showing another view of mechanism illustrated in 29B.

| Ref/FIG | Element | Description |
|---|---|---|
| | | Drum 370. |
| 374 | Capstan Roller Gears | The gears which are directly keyed to the Capstan Rollers 372 and which are driven by the Capstan Sun Gear 368. |
| 376 FIG. 17 | Infeed Guide Funnel | The conical guide into which the wire initially feeds as it travels into the capstan 364. |
| 378 | Infeed Guide | The guide block that guides the wire from the Infeed Guide Funnel 376 to the first Capstan Roller 372. |
| 380 | Outfeed Guide | The guide block that guides the wire from the last Capstan Roller 372 to the Feed Tube 382. |
| 382 | Feed Tube | The tube that guides the wire from the Outfeed Guide 380 to the Spinner Head 332. |
| 384 FIG. 15 | Talon Overload Clutch | The torque limiting clutch directly driven from the Intermediate Pinion 310 which directly powers the Talon Lead Screw Shaft 386. |
| 386 | Talon Lead Screw Shaft | The threaded shaft which drives the Talon Lead Screw Nut 388 fore and aft. |
| 388 | Talon Lead Screw Nut | The threaded nut, driven by the Talon Lead Screw Shaft 386, which is directly connected to the Talon Pushrod 390. |
| 390 | Talon Pushrod | The rod driven by the Talon Lead Screw Nut 388 which moves fore and aft as the Talons 400, 401 are closed and opened. |
| 392 | Lower Talon Lever | The lever on the bottom of the tool that is actuated by the Talon Pushrod 390 and which drives the Talon Cross Shaft 398 and the lower Talon Connecting Rod 396. |
| 394 FIG. 22 | Upper Talon Lever | The lever on the top of the tool that is actuated by the Talon Cross Shaft 398 and drives the upper Talon Connecting Rod 397. |
| 396 | Talon Connecting Rod (lower talon) | The adjustable rod which connects the Lower Talon Lever 394 to the Lower Talon 401. |
| 397 | Talon Connecting Rod (upper talon) | The adjustable rod which connects the Upper Talon Lever 392 to the Upper Talon 400. |
| 398 | Talon Cross Shaft | The torsion shaft which ties the Upper and Lower Talon Levers 394 and 392 together. |
| 400, 401 FIG. 13 | Upper Talon and Lower Talon | The moving jaws which open to allow the tool to be placed around a bundle of rebar (or other items to be tied) and close to establish the wire path so that wire can be fed through the tool. |
| 402 (not shown) | Moving Inserts | (optional, alternative concept to the traps doors 404) The floating plates which contain the encapsulating portions of the talon wire path, which are cammed into place when the Talons close. |
| 404 FIG. 31 | Trap Doors | (alternative concept to the Moving Inserts 402) The spring-loaded doors which contain the encapsulating portions of the wire path, and which open and close with a pivoting action rather than a floating action as the Talons open and close. |
| 406 FIG. 28 | Spinner Detent Hub | The part that mounts on the aft end of the Spinner Shaft 326 that enables the Spinner Shaft to be locked in the forward position, which includes the Helper Spring Roller 407 for compressing the Helper Spring 424 and which has a pin 409 to engage the Detent Latch 412. |
| 406A | Detent Lobe | The cam feature on the Spinner Detent Hub 406 which engages the detect roller 410 to lift the detect arm 408. |
| 407 | Helper Spring Roller | The roller carried on the Spinner Detent Hub 406 for compressing the Helper Spring 424. |
| 408 | Detent Arm | The swinging spring loaded arm on which the Detent Roller 410 is mounted, which locks the Spinner Detent Hub 406 in place when the Spinner Shaft 326 is in the forward position. |
| 408A | Detent Spring | The extension spring that pulls the Detent Arm 408 downward opposing the lifting action of the Detent Lobe 4067A on the Detent Rollar 410. |
| 409 | Pin | The pin carried on the Spinner Detent Hub 406 for engaging the Detent Latch 412. |
| 410 | Detent Roller | The roller mounted on the Detent Arm 408. |
| 412 | Detent Latch | The pivoted latch mounted on the Detent Arm 408 which engages the pin 409 on the Detent Hub 406. |
| 414 | Latch Inhibit Lever | The pivoted lever that inhibits the Detent Arm 408 from latching. |
| 416 | Latch Release Finger | The pivoted finger which trips the Detent Latch 412 so the Detent Hub 406 can rotate away from the Detent Roller 410 (unlocking the detent hub 406). |
| 418 FIG. 29 | Latch Inhibit Lever Cam Pin | The pin actuating the Latch Inhibit Lever 414 (away from its inhibit position) that is cammed by the Cam Plate 422 when the Talons 400, 401 are closed (pushrod 390 is in its forward position). |
| 420 | Latch Release Finger Cam Pin | The pin actuating the Latch Release Finger 416 that is cammed by the Cam Plate 422 when the Talons 400, 401 are open (pushrod 390 is in its aft position). |
| 422 | Cam Plate | The plate having two cam features, 423 and 425 and which is mounted on the Talon Pushrod 390. |
| 423, 425 | Cam Features | The two cam features of cam plate 422. |
| 424 FIG. 28 | Helper Spring | The compression spring that is compressed just before the Spinner Detent Hub 406 locks into position and which provides helping torque to the spinner head 332 when it cuts the wire. |
| 426 FIG. 14 | Rear Limit Sensor | The proximity switch that senses when the Spinner Shaft 326 has retracted, and which then signals the motor 300 to stop. |

Having now completed the overview of the second embodiment, and having set forth a glossary of terms, the detailed discussion which follows will describe the motor, the motor gears and differential, and each of the three drive mechanisms, in turn.

The Motor, Motor Gears and Differential

With reference to FIG. 14, it may be understood that the motor 300 is a reversible motor which powers the tool. Good results have been obtained using a universal AC/DC reversible motor of approximately one-quarter to one-third horse power. A small electronic control module (not separately numbered) is used to start, stop and reverse the motor at appropriate points during the cycle.

It is to be emphasized that alternate power sources, other than a universal AC/DC reversible motor, may be used to practice the invention, such as hydraulic motors/pistons, pneumatic motors, and/or gasoline powered motors.

Motor pinion 302 is a small diameter gear integral to motor shaft 301. The motor pinion 302 drives two planetary gears 304 held within planetary cage 306. Coaxial ring gear 308 is the internal gear which the planetary gears 304 drive against, and intermediate pinion 310 is driven by the planetary cage 306. Intermediate pinion 310 drives main drive gear 312. As will be explained later in connection with the differential input shaft 316 and differential 318, the main drive gear 312 is the source of power for the spinner drive and the wire drive by way of main overload clutch 314.

Main overload clutch 314 is a torque limiting clutch directly driven by the main gear 312. The main overload clutch 314 directly drives differential input shaft 316. Differential input shaft 316 supplies power to the differential 318 which is mounted in differential cage 320. Differential 318 is a power splitting device which powers either the spinner drive or the wire drive.

Spinner Drive

With reference now to FIG. 20 (and also with reference to FIG. 14 for the relation of the spinner drive to the differential 318 and differential cage 320), it may be understood that the spinner drive takes off from the differential 318 by way of spinner drive pinion 322 which is mounted to the differential cage 320. Spinner drive pinion 322 drives spinner gear 324 which imparts rotation to spinner shaft 326. Spinner drive spline 328, in cooperation with spinner drive thread 330, permits linear movement of the spinner shaft 326 during rotation of the shaft while also transmitting torque.

Spinner head 332 is the head which extrudes the knots after wire has been fed through the head and pulled back. It operates in the same fashion as spinner head 100 previously described in connection with the first embodiment. The spinner head 332 shears the wire against two cutter blocks 334 when the spinner head starts to spin and the knot is extruded.

In connection with the spinner, there are a number of other elements to be seen. These include mechanical logic elements which will be mentioned now, but described in greater detail later. With reference to FIG. 21, wire sensor toggle 336 is a spring loaded rotating tab which cams and triggers wire sensor 338 when the wire feeds through the spinner head 333. Wire sensor 338 is a proximity switch. When triggered, the wire sensor 338 will stop and reverse the motor 300. It may be seen that a tab 337 on wire sensor toggle 336 is in the wire path. As the wire is fed through the path, the wire will hit tab 337, actuating toggle 336 to contact the wire sensor 338, stopping and reversing the motor 300. When the wire is pulled back, the spring-loaded toggle 336 will urge tab 337 against the wire, locking the wire in place. Tab 337 is drawn to a point for this purpose.

Wire Drive

Referring again to FIG. 14, it will be remembered that differential 318 is the power splitting device which powers either the spinner drive or the wire drive. With reference now to FIG. 24, it can be seen that the wire drive takes off from the differential 318 by way of wire drive driver miter gear 356 which is mounted on the end of differential output shaft 340. Referring to FIG. 25, a wire drive driven miter gear 358, driven by driver miter gear 356, is directly coupled to wire drive overload clutch 360.

In contrast to the first embodiment of the wire tying tool, previously discussed in connection with FIGS. 1 through 12, and which used either a wheel drive or a belt drive to feed the wire from the spool to the talons, a preferred mechanism for feeding the wire in the second embodiment of the tool, now being discussed in connection with FIGS. 13 through 32, is a capstan 364 (see FIG. 13) that is driven by the wire drive and which feeds and pulls back the wire.

With reference again to FIG. 25, wire drive overload clutch 360 is a torque limiting clutch that supplies power from motor 300 to the capstan 364 by way of capstan drive shaft 362.

The capstan 364 itself can be better understood with reference to FIGS. 16, 17, 18 and 19. The capstan includes a capstan drum 370, which is a smooth steel drum around which the wire will wrap during its passage through the capstan, and the capstan also includes a set of capstan rollers 502, 504, 506, 508, 510, 512, 514, 516, 518, 520 (the rollers are sometimes, and when it is not necessary to distinguish among them, collectively referred to with reference numeral 372). A capstan sun gear 368 drives the drum 370, and is itself driven by capstan drive pinion 366. Pinion 366 is keyed to the capstan drive shaft 362 (previously discussed in connection with FIG. 25). The rollers 372 are grooved and spring loaded by capstan roller springs 373 against the capstan drum 370. Roller gears 374 are directly keyed to the rollers 372 and are driven by sun gear 368.

A conical infeed guide funnel 376 receives and guides the wire from the spool 600 into the capstan 364 (see FIG. 13). Referring again to FIG. 17, it can be understood that infeed guide block 378 guides the wire from infeed guide tunnel 376 to the first of the rollers 502, and outfeed guide 380 guides the wire, after it has wrapped around the drum 370 and passed back to roller 502, to feed tube 382. Feed tube 382 is an exit tube which feeds wire exiting the capstan 364 into spinner head 332. It is off-line from the infeed guide tunnel 376 to facilitate passage of the wire around the drum 370. With reference to FIGS. 18A through 18J, it may be seen that one way to move the wire across the drum (from the infeed guide tunnel 376 to the exit feed tube 382) while the wire wraps around the drum is by using a number of capstan rollers 372. The rollers are grooved, the grooves progressively offset from roller to roller.

Figure 18A:
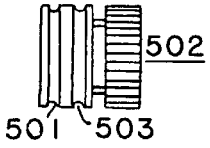
FIGS. 18A through 18J are side elevation views of the roller gears of the capstan assembly of the embodiment of FIG. 13.
Figure 18B:
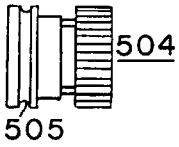
Figure 18C:
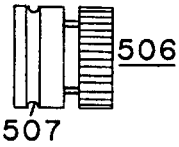
Figure 18D:
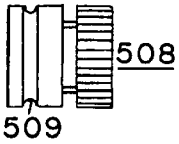
Figure 18E:
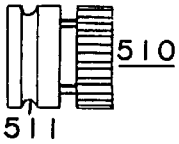
Figure 18F:
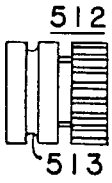
Figure 18G:
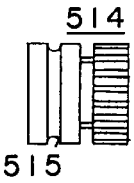
Figure 18H:
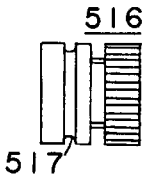
Figure 18I:
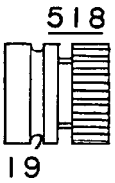
Figure 18J:
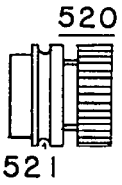

Taking as an example the first capstan roller, now identified as roller 502 with reference to FIG. 18A, it may be seen that this roller is grooved with two grooves, 501 and 503. Groove 501 is subtantially in-line with the wire path coming in from the infeed guide tunnel 376 and through the infeed guide 378 (this orientation may be understood with reference to FIG. 17. Groove 503 of roller 502 is substantially in-line with the wire path exiting the drum 370 through outfeed guide 380. The wire is progressively passed around the drum 379 by a number of rollers, each of which has a single groove progressively moving the wire from (for ease of discussion and viewing FIGS. 18A through 18J) left (where groove 501 of the first roller 502 receives the incoming wire) to right (where groove 503 of the first roller 502 is set to send the wire out of the capstan. Thus, a second roller 504 has a single groove 505 slightly offset to the right of the first roller's groove 501 (FIG. 18B); a third roller 506 has a single groove 507 slightly offset to the right of second roller's groove 505 (FIG. 18C); a fourth roller 508 has a single groove 509 slightly offset to the right of third roller's groove 507 (FIG. 18D); and so on with fifth, sixth, seventh, eighth, ninth and tenth rollers 510, 512, 514, 516, 518, 520 and their respective grooves, 511, 513, 515, 517, 519, 521, each groove slightly offset to the right from the prior groove (ref FIGS. 18E through 18J). Here, ten capstan rollers are used, but the number may readily be adjusted up or down, based on the desired application.

In connection with the wire drive, there are a number of other elements to be seen. These include mechanical logic elements which will be mentioned now, with reference to FIG. 26A, but described in greater detail later. Wire lock wheel 342 is engaged by wire lock pawl 344. Wire lock release lever 346 is a cammed lever that actuates the wire lock pawl 344. Wire lock release inhibit lever 348 engages the wire lock pawl, preventing it from disengaging the wire lock wheel 342. Wire lock release inhibit lever cam pin 350 actuates lever 348 when tripped by wire lock release inhibit lever cam 354.

Talon Drive

Referring again to FIG. 14, it will be remembered that intermediate pinion 310 which is driven by the planetary cage 306 drives main gear 312 which is the source of power for the spinner drive (previously discussed in connection with, e.g., FIG. 20) and the wire drive (previously discussed in connection with, e.g., FIG. 24). In addition, the intermediate pinion 310 also provides power to the talon drive.

Referring now to FIG. 15, it may be understood that talon overload clutch 384 is a torque limiting clutch directly driven from intermediate pinion 310. Overload clutch 384 powers the talon lead screw shaft 386, rotating it through the threaded talon lead screw nut 388, which is a threaded nut driven by the lead screw shaft 386. Talon pushrod 390 is connected to the talon lead screw shaft 386. Talon pushrod 390 is actuated fore and aft (closing and opening the talons) as the screw shaft 386 is rotated counterclockwise and clockwise.

Lower talon lever 392 is the lever on the bottom of the tool that is actuated by the talon pushrod 390. Talon cross shaft 398 is a torsion shaft, connected to (and driven by) the lower talon lever 392 and also connected to upper talon lever 394 (see FIG. 22). Referring again to FIG. 15, the lower talon lever 392 is connected to the lower talon 401 (not shown in FIG. 15) by lower talon connecting rod 396, and the upper talon lever 394 (see FIG. 22) is connected to the upper talon 400 by upper talon connecting rod 397.

It can be understood that the talon pushrod 390 cooperates with the cross shaft 398 to push both the lower talon lever 392 and upper talon lever 394. The connecting rods 396, 397 from the talon levers to the talons 400 and 401, push the talons closed and open as the pushrod pushes forward and withdraws backwards.

Talons 400 and 401 are the moving jaws which open to allow the tool to be placed around a bundle of rebar or other items to be tied, and then close to establish the wire path so that the wire can be fed through to form a loop. Talons 400 and 401 operate generally as previously described in connection with the first embodiment already discussed in connection with FIGS. 1–12. In addition to the operation earlier described, the talons may have a set of moving inserts 402 (not shown in the figures) within the interior of the talons. The moving inserts are floating plates which contain the encapsulating portions of the wire path, and which are cammed into place when the talons close (forming the wire channel), and which release as the talons open (thereby allowing the wire loop to be pulled out of the talons).

Figure 32:
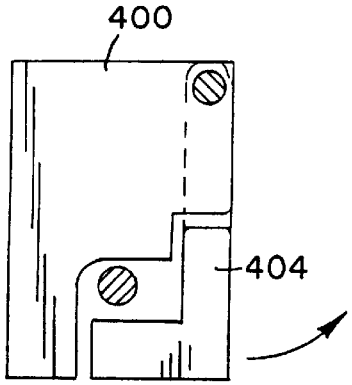
FIG. 32 is a cross sectional view showing details of the trap door assembly of a talon in the embodiment of FIG. 13.

Alternatively, trap doors 404 (see FIGS. 31 and 32) in the talons 400, 401 open and close with a pivoting action as the talons are opened and closed, likewise forming the wire channel and then releasing the loop at the appropriate time. The trap doors 404 are opposed spring-loaded trap doors, the trap doors being urged by springs to open as the talons pivot to an open position. The trap doors 404 are opposed in the sense that one opens to the left side, and the other opens to the right side of the talons; and the heels of each trap door are butted against one another so that when the talons are closed the trap doors mutually inhibit one another from opening, but as the talons begin to open (moving the heels of the doors apart), the spring pressure on the trap doors urges them to open. The cross sectional view of FIG. 32 shows the pivoting action of door 404 in upper talon 400, better showing how, when the ends of the opposed doors 404 are butted against one another when the talons are closed, the doors are inhibited from opening.

In connection with the wire drive, there are a number of other elements to be seen. These include mechanical logic elements which will be mentioned now, but described in greater detail later. Because of the necessity that the talon drive be sequenced in relation to the spinner drive and the wire drive (so that, for example, the wire drive does not feed wire unless the talons are closed), and because the spinner drive interacts with the wire drive, many of the components introduced here include elements associated with the spinner drive.

Referring to FIG. 28, spinner detent hub 406 mounts on the aft end of spinner shaft 326 and serves to lock the spinner shaft in the shaft-forward position. Spinner detent hub includes a helper spring roller 407 for compressing a helper spring 424 and also has a pin 409 to engage a detent latch 412.

Detent roller 410 is mounted on detent arm 408, which is a swinging spring loaded arm that locks spinner detent hub 406 in place when the spinner shaft 326 is in the forward position.

Detent latch 412 is a pivoted latch mounted on the detent arm 408. Latch 412 engages the pin 409 on detent hub 406.

Latch inhibit lever 414 is a pivoted lever that inhibits the detent arm from latching. Latch release finger 416 is a pivoted finger which trips the detent latch 412 so that the detent hub 406 can rotate away from the detent roller 410.

The foregoing latches and releases are related to the position of the talons 400, 401 by latch inhibit lever cam pin 418 (see FIG. 29), latch release finger cam pin 420, and cam plate 422. Latch inhibit pin 418 is cammed by the cam plate 422 when the talons are closed (pushrod 390 is forward). Latch release finger cam pin 420 is cammed by the cam plate when the talons are open (pushrod 390 is aft). The cam plate 422 has two cam features, 423, 425, and is mounted on talon pushrod 390.

Referring now to FIG. 28, helper spring 424 is a compression spring that is compressed just before the spinner detent hub 406 locks into position and it provides the helping torque to the spinner when it cuts the wire. The detent roller 410 on the spinner detent hub 406 compresses the helper spring 424.

With reference to FIG. 14, rear limit sensor 426 is a proximity switch that senses when the spinner shaft 326 has retracted, and then signals the motor 300 to stop.

Sequence Of Operations

The operation of the wire tying tool of the present invention is divided into the three main operations previously described: spinner drive, talon drive and wire drive.

The spinner drive actuates the spinner head 332 through the spinner shaft 326. The spinner head forms knots by "extruding" the wire with rotary motion while retracting in a controlled manner.

The talon drive actuates the talons 400, 401 during the cycle of the tool, closing them at the beginning of the cycle to establish the wire path and opening them after the wire has been driven through the path at the beginning of wire pullback.

The wire drive powers the capstan 364 which pulls wire from the supply spool, pushes it through the talons 400, 401, then reverses for "pullback" just before the knot is extruded.

These three functions are coordinated using mechanical logic to achieve the proper sequencing and power flow during the cycle of the tool. A single motor is used to power the tool and a small electronic control module is utilized to start, stop and reverse the motor at appropriate points during the cycle.

The sequence of operations of the wire tying tool will now be described, together with certain variations which may occur. All of the components have already been explained in connection with the figures. Those discussions will not be repeated here, but the reader may refer back to the glossary for aid in locating any of the components and the associated figure.

1. Starting configuration. At the beginning of the cycle, the talons 400, 401 are open, spinner shaft 326 is retracted, and the wire drive is locked (wire lock wheel 342 is engaged by wire lock pawl 344, and the wire lock pawl is latched in place by wire lock release inhibit lever 348—this holds the wire lock wheel 342 stationary which, in turn, prevents movement of the capstan drive shaft 362 and of the differential output shaft 340, thereby locking the wire drive). See FIG. 26A.

From this starting position, the tool is brought into operation as follows. In the discussion which follows "clockwise" and "counterclockwise" will describe rotational directions as viewed along (or generally parallel to) the longitudinal axis of the tool, as viewed from the rear of the tool; "RPM" will mean revolutions per minute; and a "cycle" will mean one complete sequence of the tool for tying one knot.

2. Trigger pull (powering the intermediate pinion). From the starting configuration, the operator will position the open talons 400, 401 around the rebar joint to be tied. When the talons are properly positioned, the operator pulls the main trigger 606.

The trigger pull starts drive motor 300 running in the counterclockwise direction. The motor pinion 302 drives the two planetary gears 304 which drive against the ring gear 308 thereby rotating the planetary cage 306 which directly drives the intermediate pinion 310 counter clockwise. This powers the main drive gear 312 clockwise which is the source of power for both the spinner drive and the wire drive.

The planetary gearing of the planetary gears 304 achieves the initial reduction needed to get from the high motor RPM down to a speed range more practical for the three drive systems.

At this point in the cycle, the intermediate pinion 310 is powered, and ready to drive both the talon drive and the spinner drive as detailed below.

3. Power to the Talon Drive and to the Spinner Drive (closing the talons and advancing the spinner shaft). In the sequence of operation, the third step simultaneously powers the talon drive and the spinner drive, while the wire drive is locked. The purpose of the third step is to put the wire tying tool in position for the wire drive to form the knot. Thus, it is imperative that the talons be completely closed and the spinner head locked into place so that the wire channel is properly formed and ready to receive the wire. At the end of this third step, therefore, the talons will have closed and the spinner shaft will have advanced to its fully forward position. When both of these conditions have been met, the wire drive will be unlocked, and the third phase in the sequence will come to its end.

3(a). Power To The Talon Drive (closing the talons). The counter clockwise motion of the intermediate pinion 310 (see step 2 above) directly drives the talon overload clutch 384 which in turn directly drives the talon lead screw 386 which rotates counter clockwise. The counter clockwise rotation of the talon lead screw 386 drives the lead screw nut 388 forward which in turn drives the talon pushrod 390 forward.

The forward motion of the talon pushrod 390 rotates the lower talon lever 392 by means of a pin engagement. the lower talon lever 392 in turn rotates talon cross shaft 398 which then rotates the upper talon lever 394.

Connected to the upper and lower talon levers 392, 394 are two talon connecting rods 396 which are connected to the talons 400 and 401. The rotation of the talon levers 392 and 394 push on the connecting rods 396 which close the talons.

It should be remembered that the intermediate pinion 310 is powering both the talon drive and the spinner drive simultaneously. Thus, the spinner is moving forward even as the talons are closing. The movement of the spinner will be discussed below, but for now it should be noted that the talons 400, 401, if not obstructed (the situation where the talons are obstructed is discussed in step 3(b) below), will reach a fully closed position substantially quicker than the spinner shaft 326 will reach its fully forward position.

3(b). Power to the Spinner Drive (moving the spinner shaft forward and locking it). The counter clockwise motion of the intermediate pinion 310 (see step 2 above) rotates the main drive gear 312 clockwise. The main drive gear 312 directly rotates the main overload clutch 314 which rotates the differential input shaft 316 clockwise. This will supply power to the differential 316.

At this point in the cycle, the wire drive is still locked (see step 1), therefore, the differential output shaft 340 is locked. This causes the torque from the differential input shaft 316 to be transmitted to the differential cage 320.

Rotating clockwise, the differential cage 320 directly drives the spinner drive pinion 322 which in turn rotates the spinner drive gear 324 counter clockwise.

The spinner drive gear 324 engages the spinner drive spline 328, rotating it counter clockwise, which in turn rotates the spinner drive thread 330 counter clockwise.

The counter clockwise rotation of the spinner drive thread 330 and spinner drive spline 328 causes the spinner shaft 326 and spinner head 332 to move forward while the spinner drive spline 328 slides through the spinner drive gear 324.

As the spinner shaft 326 nears its full forward position, the detent lobe 406A on the spinner detent hub 406 engages the detent roller 410 lifting the detent arm 408 and stretching the detent spring 408A.

When the spinner shaft 326 reaches its full forward position, the detent roller 410 drops behind the detent lobe 406A on the spinner detent hub 406, locking the shaft into the forward position. At this point, the detent arm 408 is latched down by virtue of the pin 409 on the spinner detent hub 406 which engages the detent latch 412. In addition, as the detent hub is locked into position, the Helper Spring Roller 407 compresses the Helper Spring 424.

As previously noted, the talons 400 and 401 are being closed at the same time as the spinner shaft 326 is being moved forward. If not obstructed, the talons will reach a fully closed position before the shaft 326 reaches its fully forward position (see step 3(a) above). But if the talons are obstructed (or were placed around too large a bundle), or have for any other reason not fully closed before the spinner shaft 326 has reached its full forward position, it is desirable not to latch the spinner detent hub 406 into place. This is because the operator will want to reverse the tool and reset the talons and the spinner shaft to the starting configuration (talons open, spinner retracted)—leaving the spinner shaft unlatched in the event that the talons have not closed will allow the operator more easily to reverse the tool (as will be explained later) and reset it to the starting configuration.

To prevent the spinner shaft 326 from latching and locking in its fully forward position when the talons have not closed, the inhibit lever 414 is spring loaded counter clockwise and engages the detent arm 408, preventing it from dropping far enough to latch.

However, if the talons 400 and 401 have previously closed (or subsequently do close), the cam feature 423 of cam plate 422 on the talon pushrod 390 will have moved forward far enough to push the latch inhibit lever cam pin 418 which, in turn, rotates the latch inhibit lever 414 clockwise, enabling the detent arm 408 to drop fully and be to latched and locked by the detent latch 412 engaging the pin 409 on the detent hub 406.

3(c). Unlocking the Wire Drive (and locking the spinner head). In this third phase of operation, the talons 400 and 401 are closing (see step 3(a) above), and the spinner shaft 326 is moving to the fully forward position (see step 3(b) above). While both the talon drive and the spinner drive are moving simultaneously, the talons will close first, and then the spinner shaft will reach its forward and locked position. At this point, it is time to release the wire drive (which was locked in the initial configuration, see step 1 above).

When the talons 400 and 401 close normally (before the spinner shaft 326 is fully forward), the talon pushrod 390 will have advanced to its fully forward position. Accordingly, the wire lock release inhibit lever cam 354, mounted on the talon pushrod 390, will cam the wire lock release inhibit lever cam pin 350. The movement of release pin 350 rotates the wire lock release inhibit lever 348 clear so it no longer prevents the wire lock pawl 344 from lifting away from the wire lock wheel 342. See FIG. 26B. This fulfills one of two conditions for unlocking the wire drive (that is, the talons are closed) and enables the wire drive to be unlocked when the second of the two conditions is met (that is, when the spinner shaft 326 later reaches its fully forward position).

The discussion now continues on the assumption that the talons have closed. As the spinner shaft 326 reaches its fully forward position and the detent hub 406 latches into place, the spinner drive thread 330 will have moved into its fully forward position. Accordingly, the wire lock release tab 352, which is integral to the spinner drive thread 330, will have cammed the wire lock release lever 346. As a result, wire lock release lever 346 pushes on a spring, which actuates the wire lock pawl 344, disengaging it from the wire lock wheel 342. See FIG. 26C At this point, each of the two conditions have been met (that is, the talons are closed and the spinner shaft is at its fully forward position) and the wire drive is unlocked.

The wire tying tool of this invention is designed also to take account of the possibility that the talons 400 and 401 might not be fully closed (because they have met an obstruction or the joint to be tied is too large) when the spinner shaft 326 reaches its fully forward position and the wire lock release tab 352 cams the wire lock release lever 346. In this event the second of the two conditions for releasing the wire drive (that is the spinner drive is forward) will have occurred, but the first condition will have failed (that is, the talons are not completely closed). If this is the case, the wire lock pawl 344 is inhibited from moving by the wire lock release inhibit lever 348, and this will prevent a premature unlocking of the wire drive. This is done by spring loading the wire lock release inhibit lever 348 in the inhibit position, where it latches the wire lock pawl 344 to prevent its lifting from the wire lock wheel 342. In this case, power can neither be transmitted to the spinner drive nor to the wire drive, and will be released through the main overload clutch 314. Because the wire drive remains locked, the wire will not feed, and the operator of the tool will be able to disengage and reset.

The discussion will resume under the assumption that the talons have closed, the spinner shaft is forward, and the wire drive is, accordingly, unlocked.

3(d). Intermediate configuration (talons closed, spinner shaft forward, wire drive unlocked). At this point, with the talon drive having closed the talons, and with the spinner drive having driven and locked the spinner shaft into its fully forward position, the wire tying tool is in an intermediate configuration. The talons are now closed, the spinner shaft is now forward and locked, and the wire drive is now unlocked.

4. Power to the Wire Drive (forming and pulling the loop). In the sequence of operation, the fourth step powers the wire drive in two directions to form the loop and then to pull back on it. In the first direction, the wire is driven through the capstan, through the first opening in the spinner head, around the talons and out through the second opening in the spinner head.

4(a) Wire Drive Feed Phase (forming the loop). Since the spinner shaft 326 is fully forward and the spinner detent hub 406 is latched in place (see step 3 above), the differential cage 320 can no longer rotate. The power, previously directed to the talon drive and the spinner drive (see step 3 above) must now be directed to the differential output shaft 340 for power ing the wire drive. While this is happening, power is still being supplied to the talon lead screw 386 of the talon drive, but the drive is immobilized and the power is relieved through talon overload clutch 384.

With the wire drive now unlocked, power is transferred through the differential output shaft 340, past the wire lock wheel 342 to the wire drive driver miter gear 356, which drives the wire drive driven miter gear 358. The driven miter gear 358 directly drives the wire drive overload clutch 360.

From the wire drive overload clutch 360, power is transmitted to the capstan drive shaft 362 which directly drives the capstan drive pinion 366. The capstan drive pinion 366 drives the capstan sun gear 368 which directly drives the capstan drum 370 and drives the capstan roller gears 374 which directly drive the capstan rollers 372.

Wire is pulled from the spool 600, and enters the capstan 364 through the infeed guide funnel 376 whence it passes through the infeed guide 378. The wire is then fed into the left groove of the first capstan roller 502 where it is pinched against the capstan drum 370 to provide driving force. The wire is guided to the groove in the second capstan roller 504 with a slight offset to the right, again pinched against the capstan drum 370 to add to the driving force. The wire continues all the way around the capstan drum 370 past ten rollers 372, each having a slight offset to the right until it reaches the right groove on the original roller 502 (this being the only roller having two grooves) whence it passes into the outfeed guide 380 where it exits the capstan 364 into the feed tube 382.

From feed tube 382, the wire then passes through the opening in the top side of spinner head 332, around the channel in the talons 400 and 401, and back through the opening in the bottom side of spinner head 332, exactly as previously discussed in connection with the first embodiment and, e.g., FIG. 11. Reference is made to that earlier discussion for the details. The wire feeds a short distance out of the bottom of the spinner head, until it contacts wire sensor toggle 336. Toggle 336 rotates upon being contacted with the wire, and the toggle 336 will meet, and trigger, wire sensor 338.

4(b) Wire Drive Pullback Phase (pulling the loop).

When the wire is looped through the spinner head 332 and the talons 400 and 401, and the wire end has hit the sensor toggle 336, it is time to pull back on the loop. The wire sensor 338 is a proximity switch, triggered by the sensor toggle 336. A signal from wire sensor 338 to the reversible motor 300 stops and reverses motor 300.

Because the spinner head is locked (see step 3 above), the reversed motor will power the talon drive and the wire drive, but not the spinner drive. Immediately upon reversal, the talons 400 and 401 start to open, and the capstan 364 starts pulling the wire back.

As the wire pulls back and the talons begin to open, the trap doors 404 open, allowing the wire to escape from the talons 400 and 401 as the loop is being tightened around the bundle of rebar. As the wire tightens around the rebar, the wire sensor toggle tab 337 cams to lock the wire end.

This mechanism works to prepare the tool for the knot forming step under any of several circumstances.

If, for example, a small bundle of rebar is being tied, the talons will open fully before the wire is pulled back completely by the capstan 364.

If, instead, a large bundle of rebar is being tied, the capstan 364 will tighten up the wire before the talons 400 and 401 are fully open. In this case, wire drive overload clutch 360 will hold the wire tight and will relieve torque using a detenting action until the talons reach their fully opened position, and the knot forming step begins.

If, finally, the talons are prevented from fully opening for any reason, the capstan 364 will pull the wire tight, and the wire drive overload clutch 360 will hold the wire tight and will relieve torque by detenting until the talons are allowed to open fully.

4(c) Unlocking the Spinner Head (and relocking the wire drive). In this fourth phase of operation, the talons are opening and the wire drive is pulling back. When the talons 400 and 401 are fully open and the wire is pulled tight, it is time to unlock the spinner head 332 so that the knot forming operation can begin.

When the talons 400 and 401 fully open, the talon pushrod 390 will have backed up to its fully retracted position. Accordingly, cam feature 425 of cam plate 422, mounted on talon pushrod 390 will have activated the latch release finger cam pin 420, rotating and lifting latch release finger 416. Finger 416 is a pivoted finger which trips the detent latch 412 so that the spinner detent hub 406 can rotate away from detent roller 410. It will be remembered that, at step 3(b) above, the detent roller 410 had dropped behind the lobe on spinner detent hub 406, locking the spinner shaft 326 into position—detent arm 408 was latched down by the engagement of the pin 409 on detent hub 406 with detent latch 412. Now, when the detent latch 412 is tripped, it will return to its unlatched position. This allows the detent arm 408 to lift, thereby unlocking the spinner shaft 326.

As the capstan 364 pulls back on the wire, tightening the loop around the rebar bundle to be tied, sufficient torque is transmitted to the spinner shaft 326 through differential 318 to rotate the spinner detent hub 406 clockwise. "Sufficient torque" is a preset value, set to match the desired pull back tension (this can be anywhere from five pounds or less, to 150 pounds or more, or any value between). This lifts the detent arm 408, which permits spinner detent hub 406 to rotate clockwise. As hub 406 rotates, the wire lock release tab 352 rotates away from wire lock release lever 346. This allows the wire lock pawl 344 to engage wire lock wheel 342 which then locks the wire drive. See FIG. 26A.

At this point, the talons are fully open, the wire drive is locked, the spinner drive is unlocked, and the motor is running in a clockwise direction.

5. Power to the Spinner Drive (knot forming operation—retracting the spinner shaft and extruding the knot). At this point, with the talons open and the wire drive locked, full drive torque is transmitted to the spinner shaft 326 and spinner head 332. This provides full power to the knot forming operation.

As spinner head 332 starts to rotate in a clockwise direction, the wire starts to bend where it enters and exits the spinner head 332. The bending action puts kinks in the wire ends to allow the spinner head to apply tension to the wire ends while the wire knot is being extruded.

At the same time, and as the spinner shaft 326 starts to rotate in a clockwise direction, the helper spring 424 which was previously compressed (see step 3(b) above), provides an additional force which pushes on the helper spring roller 407 of the spinner detent hub 406.

As the kinking is being completed, wire cutting begins. The wire is cut, first, at the entrance to the spinner head 332 and then at the exit from the spinner head. This is a staggered cutting action which reduces the torque requirement to the spinner shaft. The cutting is powered by the combined torque from the drive motor 300 and helper spring 424.

The spinner head 332 continues to rotate, completing the cut and rotating four turns. This extrudes the knot and returns the spinner shaft to its retracted position. When the spinner shaft 326 reaches the fully retracted position, rear limit sensor 426 (a proximity switch) signals the motor 300 to shut off.

6. Reset to the Starting Configuration. When motor 300 shuts off, the operator releases the trigger. At this point, the tool is back in the starting configuration—the talons 400, 401 are open, spinner shaft 326 is retracted, and the wire drive is locked—and the operator can move the tool to a new location, and place the talons around the next rebar bundle to be tied. When the operator pulls the trigger, the next cycle will commence.

7. Reversing Button (Obstructions. Jams, Stowage & Repair). The wire tying tool has a reverse button 608 which allows the operator to reverse the direction of the drive motor 300 at any point in the cycle. The action of the reversing button at various points in the cycle will be explained now.

(a) At an early part of the cycle (see the beginning of step 3(b) above), the talons 400 and 401 are closing, and the spinner shaft 326 is moving forward but is not yet locked into place. Actuating the reverse button at this point will open the talons and retract the spinner shaft 326.

(b) At an intermediate part of the cycle (see step 3(d) above), the talons 400 and 401 are closed, the spinner shaft 326 is fully forward and locked, and the wire drive is unlocked. The wire drive is engaged and wire is being fed forward through the talons. Actuating the reverse button at this point will open the talons and simultaneously pull back on the wire.

(c) Later in the cycle (see step 4(b) above), the wire has been fed all the way through the talons 400 and 401, and the wire end is sensed. The motor 300 now reverses (so that it is running in the clockwise direction) and the talons begin to open as the wire is being pulled back. Actuating the reverse button at this point will close the talons and feed the wire forward.

(d) Still later in the cycle (see step 5), the wire has been pulled back tight, the talons 400 and 401 are fully opened, and the detent hub 406 has pulled free, unlocking the spinner shaft 326. The wire is cut, and the spinner is rotating and retracting as it spins the knot. Actuating the reverse button at this point will drive the spinner shaft forward and close the talons.

The reverse button would be actuated at the foregoing points in the cycle as necessary and in circumstances such as the following:

For Wire Remnant Removal. When a spool of wire has been fully used, there may be a remnant of wire left within the wire tying tool which should be removed before starting a new spool. Removal is accomplished by triggering the tool and advancing it just far enough in the cycle to engage the wire drive and begin feeding the wire into the talons. Here, the reverse button will interrupt the cycle, the wire drive will reverse, and the wire will be pulled backwards out of the capstan 364. Now the operator can start the new wire end of the new spool into the capstan, and can proceed with normal operation of the tool.

For Clearing Talon Obstructions. If the talons 400 and 401 are placed around a bundle too large to be fully enclosed by the talons so that the talons will not close (of if the talons are obstructed for any reason and do not close), the reverse button will stop and reverse the talons. The talons will open, and the spinner shaft 326 will retract. Now the tool is reset and the operator may resume normal operation.

For Clearing Wire Jams. If there is a wire jam during feeding, the operator may use the reverse button to reverse the wire feed. This usually clears the jam. If the jam is not cleared, the operator can alternately drive the wire forward and backwards using the trigger 606 and reverse button 608 to clear the jam as necessary. When the wire jam is cleard, the operator may then start the cycle over.

After Tool Stowage. Before the tool is stowed, the operator will pull the trigger 606 to close the talons 400 and 401. Before reusing the tool after storage, the operator must actuate the reverse button 608 to open the talons to the initial configuration.

For Maintenance and Repair. For maintenance and repair, the reverse button can be used as needed, and in conjunction with the trigger 606, for positioning the spinner and talons, testing the mechanical logic, testing the various clutches and differentials and the like.

The foregoing description has explained the tool, with reference to the embodiment of FIGS. 1–12 and the embodiment of FIGS. 13–32. The various assemblies, including the talons and spinner, for enclosing a rebar joint or any other object to be tied and for forming a knot by looping a length of wire around the object, keeping the loop under tension, and then spinning and extruding the knot, have been explained. Likewise, the various drives, including the talon drive, wire drive and spinner drive for transmitting power from a single motor to the talons, the wire pusher/puller mechanism and the spinner have been explained, together with a control system for sequencing the various operations.

The method of using the tool has been explained in the course of desribing its components and their operation. It should be clear that an operator simply places the talons around the object to be tied, pulls the trigger, and then pulls the tool away, leaving a twisted knot behind. The machine can tie several knots per minute (variables affecting the number of ties include the thickness of the material to be tied, and the distance between ties—under controlled conditions of thickness and closeness a prototype of the device has tied about 20 knots per minute).

Once the concept of this invention is understood, it should be apparent that any number of variations or substitutions may be made, still within the scope of the invention. Beyond the obvious substitution of electronic logic control devices for the mechanical logic devices already described, some of the other additions and variations will be briefly described below.

Additions and Variations

Figure 30:
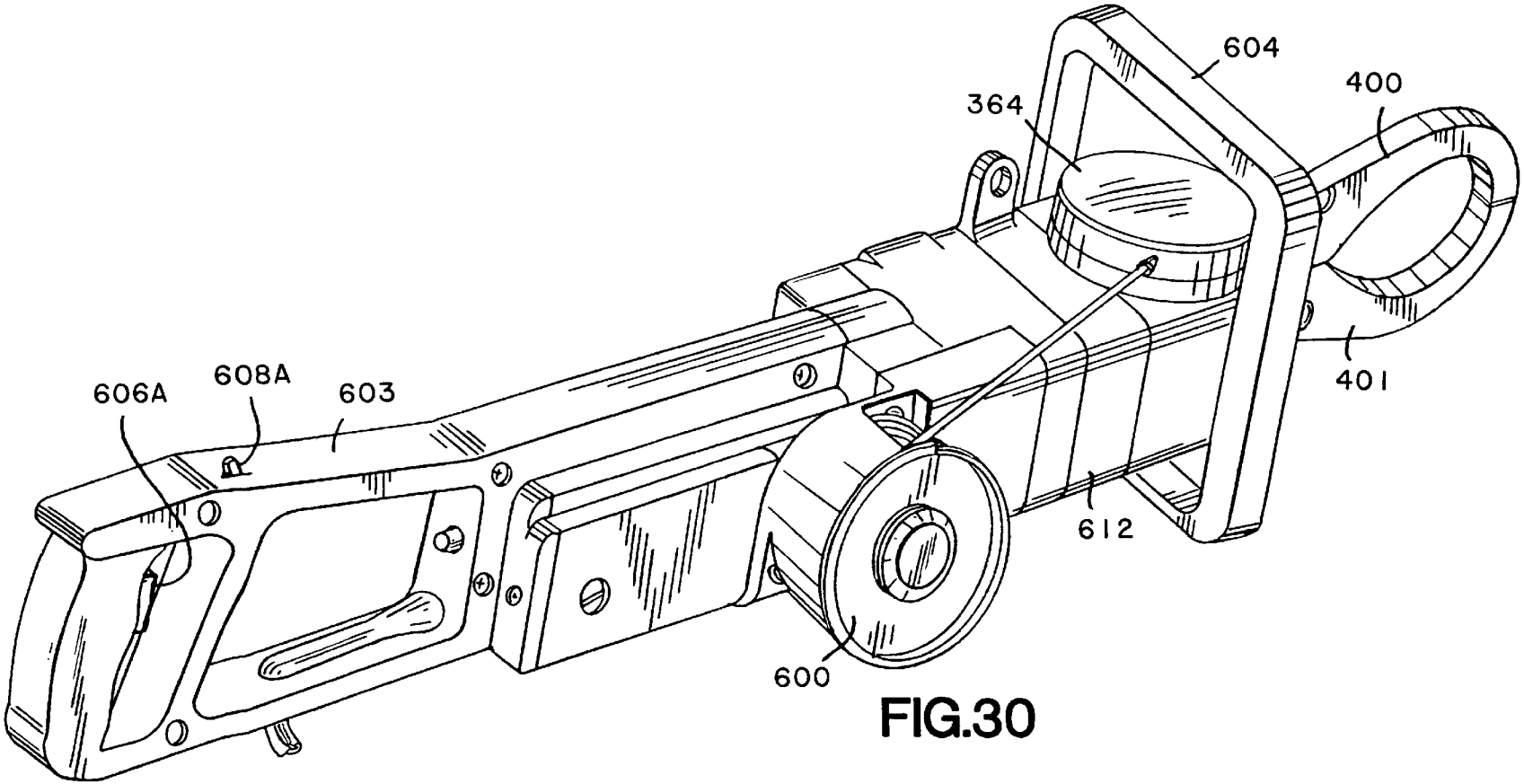
FIG. 30 is a perspective view showing a long-handled version of the embodiment of FIG. 13.

Among the additions and variations are these:

(a) An Elongated Handle. The handle 602 as shown in FIG. 13 is close to the tool itself. An elongated handle 603 is shown in FIG. 30. The elongated handle extends the reach of the operator, and support handle 604 might be moved towards the rear of the tool as necessary to facilitate the extension. An operator's use of the machine in certain applications (as in, for example, tying a rebar grid at the operator's feet; or in tying certain overhead objects) might be greatly facilitated by the longer reach afforded by the elongated handle. A trigger 606A and a reverse button 608A place the necessary controls within easy reach of the operator on the elongated handle 603.

(b) Talon Modifications. It has already been explained that the talon sets (or jaw sets) may help define a wire path which is fully enclosed (the embodiment of FIGS. 1–12) or partially enclosed (the embodiment of FIGS. 13–32), and that the wire-enclosing channel might open by way of swinging doors, trap doors or floating plates. Other variations are readily grasped. In addition, all that is required is an encircling enclosure. It should be readily apparent that the pair of talons shown and described herein could be replaced by a single hook-shaped talon. Such a single talon could be placed over the object to be tied and then pulled back, latched, or otherwise secured around the object.

(c) The Object to be Tied. The most obvious example of an object to be tied with the tool of this invention is a rebar cross joint. The tool is, however, not limited to a single application, but is appropriate for any object to be tied. It is also useful for any object that needs to be twisted. For example, the tool could be readily adopted to the use of forming the ties in metal clothes-hangers, in product wraps, in bag closures, in attaching wire to fence posts, and in any of an almost unlimited number of uses involving a twist-tie knot.

(d) The Wire or Other Material Forming the Knot. While the tool of this invention is especially suited for use with a heavy duty wire, it is not so limited. Any sort of material which can be twisted could be used. Thus, the expressions, "wire," "wire drive" and the like, when used in this specification, or in the claims, should be understood to include not only wire, but any material used to form the knot, the drive which pushes or pulls such material, and so on.

When a wire or other material is used, it should be clear that certain further advantages can be specified. Among them are these: (1) the wire could be coated with a sheath, coated (or treated) with a fusion bonded thermoplastic, or treated with a "slip agent" of polyethylene, and/or (2) the wire could be marked with one or more marks or stripes.

The coating or treatment is designed to vary the tack, and permits the coefficient of friction to be closely controlled (that is, the wire can be made more or less "slippery" by a coating or a treatment which decreases or increases the coefficient of friction relative to uncoated or untreated wire). The marking could be one or more stripes (perhaps a stripe every six inches, more or less) with the stripes readible by an optical or electromagnetic or other such sensing or reading device. Among other things, such a system could be: keyed to coated or treated wires to prevent wrongly coated or treated (or noncoated or nontreated) wire from being used, thereby preventing damage to the machine; keyed to count the number of marks to monitor usage of the machine and proper maintenance (or to monitor usage for purposes of charging for use of the machine); or any of several other purposes.

(e) The Spool. The spool, as shown and described in the various drawings of the several embodiments shown here, is variously clutched, spring-loaded and otherwise driven so that the wire is held under sufficient pressure to prevent its expansion on the spool. It should be readily understood that there are many equivalent mechanisms to prevent the expansion of the wire on the spool.

In addition, it should be understood that the spool is, or can be, removable (for reloading with wire) and/or replaceable (with preloaded spools). In these cases, the spool will be keyed specially to the tool so that it will mate and lock in place. Further, appropriate sensors may be used to sense when the spool is properly locked in place so that operation of the device cannot proceed without a proper spool in locked in place. Thus, in conjunction with the coated or treated wire and/or the use of marked wire, the keying system can be important to prevent the use of standard spools, and/or prevent the usage of spools not loaded with the properly coated, treated or marked wire, thereby preventing improper usage of the machine. Thus, it can be important that the spool of this invention not be a spool of standard or general design, but that the spool be specially keyed and/or sized so as to prevent improper usage.

Moreover, it should be understood that the spool might be moved away from the tool (to a remote location, including an operator's belt, backpack or other holder; and including a place removed from both the tool and the operator, such as a work-bay configuration, in any event, with appropriate feed channels). A wire may be fed, for example from an overhead feed channel directly to the tool in an appropriately designed work station. Such work stations are well known in the building trades and will not be further described here.

(f) Independent Features. The features of this invention are best enjoyed in combination, but there is no necessity that all of them always be employed together in any particular application. While it is generally an advantage to have but a single reversible motor powering all three of the wire drive, talon drive and spinner drive, it can readily be appreciated that there may be circumstances and applications in which there is a separate motor for each drive, or for any combination of two of the drives. There may be, as well, applications calling for a "forward" motor and a separate "reverse" motor.

Finally, the conceptually separate steps of feeding wire, and pulling wire; opening and closing talons; and spinning and retracting (and then spinning and advancing back to the start position) have made it convenient to discuss three corresponding drives (wire drive, talon drive, and spinner drive) and mechanisms (capstan or other feed system, talon, spinner and associated parts) as if they were three completely separate facilities. Although in the preferred embodiment, there is some physical separation among the wire drive, talon drive, spinner drive and their related mechanisms, there is nothing to prevent them from being combined into integrated units.

It should be readily understood, therefore, that it is not essential to this invention that there be any given number of discrete drives, or that all three of the particularly named drives be present. This invention is designed for use with all three drives working together as described in connection with the preferred embodiments, but it is by no means limited to the entire combination for all purposes.

What is claimed is:

1. A method of tying a wire knot around at least one object, comprising the steps of:

(a) closing at least one moveable talon around the at least one object, said talon having a wire passageway therethrough that loops around the at least one object when the moveable talon is closed;

(b) driving a length wire from a source of wire through a spinner/cutter, then through the wire passageway of the closed talon to form a loop of wire around the at least one object, and then back through the spinner/cutter, the spinner/cutter having an entrance through which the wire from the source of wire is received, and an exit through which the wire looped through the wire passageway of the closed talon is received;

(c) opening the at least one moveable talon to release said length of wire in a loop around the at least one object, said length of wire still being held at the exit of the spinner/cutter;

(d) pulling on the length of wire to tighten the wire loop around the at least one object;

(e) controlling the spinner/cutter so as to hold both ends of the wire loop while twisting the wire loop around the at least one object, thereby forming a wire knot around the at least one object, and while creating relative motion between the cutter/spinner and the at least one object as the twisting occurs to prevent the wire knot from being too tight and breaking, and cutting the wire to release it from the source of wire with the spinner cutter while holding the wire under tension as the knot is being formed.

2. The method of claim 1, wherein the step of driving the length of wire comprises drawing a length of wire from the source of wire, and powering a wire drive that pushes the length of wire in a first direction through said wire passageway.

3. The method of claim 2, wherein the step of pulling the length of wire comprises powering the wire drive in a second direction.

4. The method of claim 3 wherein the steps of pushing and pulling the length of wire comprises wrapping the length of wire around a capstan drive and rotating the capstan drive in one direction to push the wire and in the other direction to pull the wire.

5. The method of claim 1 further including forming kinks in both ends of the wire loop prior to twisting the wire loop around the at least one object, said kinks serving to help hold the wire loop in the spinner/cutter while the twisting occurs and the relative motion is created as the wire knot is formed.

6. The method of claim 1, wherein steps (a) through (e) comprise a knot-tying cycle, and wherein each step of the knot-tying cycle includes drawing power from a single power source, the power drawn from the single power source providing operating power for carrying out each step.

7. The method of claim 6 wherein the step of controlling the spinner/cutter includes storing energy in a helper spring during a first portion of the knot tying cycle, and releasing the stored energy in the helper spring during a second portion of the knot tying cycle to help cut the wire.

8. A method of tying a wire knot around at least one object, comprising: wrapping a loop of wire around the at least one object, pulling on the wire to tighten the wire around the at least one object, kinking the ends of the wire loop to form kinks that facilitate holding the wire loop tight as a knot is formed therein, and twisting the wire thus looped around the at least one object with a spinner device to form a knot while dragging the formed kinks of the wire through passages of the spinner device to provide resistance within the passages and thereby keep the wire loop tight as the knot is formed, and creating relative motion between the spinner device and the at least one object to prevent the knot from being too tight and breaking.

9. The method of claim 8, further comprising: drawing a length of wire from a wire spool, pushing and guiding the length of wire around the at least one object to form the wire loop, and cutting the length of wire to separate it from the wire spool before the knot has been formed.

10. The method of claim 9, further comprising transmitting power from a single power source to carry out the drawing, pushing and guiding, kinking, pulling, twisting while creating relative motion, and cutting operations.

11. The method of claim 10, further comprising storing energy obtained from the single power source during the drawing and pushing and guiding operations, and releasing the energy thus stored to help power the cutting operation.

12. The method of claim 8 wherein the step of wrapping the loop of wire around the at least one object comprises closing at least one moveable jaw around the at least one object, the moveable jaw having a wire passageway therethrough; and pushing a length of wire through the wire passageway to form the wire loop.

13. Apparatus for tying a wire knot around at least one object, comprising:

closing means for closing at least one talon around the at least one object, said talon having a wire passageway therethrough that loops around the at least one object when the talon is closed;

driving means for driving a length wire from a source of wire through a spinner/cutter, then through the wire passageway of the closed talon to form a loop of wire around the at least one object, and then back through the spinner/cutter;

opening means for opening the talon to release said length of wire in a loop around the at least one object, said length of wire still being held by the spinner/cutter;

pulling means for pulling the length of wire to tighten the wire loop around the at least one object;

control means for controlling the spinner/cutter, including:

means for holding both ends of the wire loop within the spinner/cutter while twisting the spinner/cutter to thereby twist the wire loop around the at least one object, thereby forming a wire knot around the at least one object, means for creating relative motion between the cutter/spinner and the at least one object as the twisting occurs, thereby preventing the wire knot from being too tight and breaking as the wire loop is twisted by the holding and twisting means, and means for cutting the wire to release it from the source of wire while holding it under tension as the wire knot is being formed.

14. The wire knot tying apparatus of claim 13, further including a single power source for powering said closing, driving, opening, pulling and control means.

15. The wire knot tying apparatus of claim 14, wherein said single power source comprises an electric motor.

16. The wire knot tying apparatus of claim 14, wherein said single power source comprises a pneumatic motor.

17. The wire knot tying apparatus of claim 14, wherein said single power source comprises an internal combusion engine.

18. The wire knot tying apparatus of claim 13, wherein the means for driving the length of wire and the means for pulling the length of wire comprise capstan drive means for pusing and pulling the wire in opposite directions.

19. The wire knot tying apparatus of claim 18, wherein the capstan drive means comprises: a capstan drive rotatably coupled to the single power source, and means for wrapping the length of wire at least 360 degrees around the capstan drive, thereby permitting the capstan to push and pull the wire in oppposite directions as the capstan is rotated in opposite directions.

20. The wire knot tying apparatus of claim 13, wherein the means for cutting the wire comprises a helper spring that stores energy during a first portion of a knot tying cycle, the knot tying cycle comprising a sequence of events resulting in the tying of a knot around the at least one object, and that releases its stored energy to assist with cutting the wire during a second portion of the knot tying cycle.

21. The wire knot tying apparatus of claim 13, wherein the means for holding both ends of the wire loop within the spinner/cutter comprises means for kinking both ends of the wire loop to form kinks in the wire, said kinks providing a restraining drag that prevents the wire from being easily pulled from the spinner/cutter as the spinner/cutter is twisted to form the wire knot.

22. The wire knot tying apparatus of claim 19, wherein the source of wire comprises a spool of wire, and wherein the knot tying apparatus further includes locking means for locking the spool of wire in place for use by the knot tying apparatus, and further wherein the driving means comprises means for drawing the length of wire from the spool of wire and directing it through the spinner/cutter and the wire passageway of the closed talon and back through the spinner/cutter, and wherein the spool of wire is coupled to a sensing means for preventing use of the tying apparatus unless the spool of wire is sensed by the sensing means as being properly locked in place by the locking means.

23. A method of tying a wire knot around at least one object, comprising the steps of:

(a) powering a talon drive in a first direction to close a talon assembly around said at least one object, said talon assembly including a wire passageway therethrough;

(b) powering a wire drive in a first direction to drive a length of wire first through a spinner/cutter, then through said wire passageway to form a loop, and then back through the spinner/cutter;

(c) powering the talon drive in a second direction to at least partially open the talon assembly and release said length of wire from said wire passageway, thereby leaving a loop of wire around said at least one object;

(d) powering the wire drive in a second direction to pull back on the wire loop in order to tighten the wire loop around the at least one object; and (e) powering a spinner/cutter drive to rotate the spinner/cutter, thereby twisting the wire loop around the at least one object to form a wire knot, and cutting the wire while holding the wire loop under tension as the wire knot is being formed.

24. The wire knot tying method of claim 23 wherein steps (a) through (e) comprise powering the talon, wire, and spinner/cutter drives from a single power source.

25. A wire tying device, comprising:

a housing;

a wire drive having an infeed opening and an outfeed opening;

a passageway for accepting wire into the infeed opening of the wire drive from a source of wire;

a spinner/cutter drive operatively coupled to a spinner/cutter, said spinner cutter having a wire entrance and a wire exit, the spinner/cutter drive including means for selectively rotating the spinner/cutter;

a talon drive operatively coupled to at least one talon, said talon having a wire passageway therethrough, the talon drive including means for selectively enclosing the wire passageway around an object;

means for transmitting power to the wire drive, the spinner drive and the talon drive, and wherein, responsive to the transmission of power, a length of wire is passed from the source of wire to the infeed opening of the wire drive, through the wire drive, into the spinner/cutter, through the passageway of the talon, and back through the spinner/cutter, and further wherein, once the length of wire has been passed back through the spinner/cutter, a wire knot is formed around the object by transmitting power first to the talon drive to open the wire passageway so as to leave a loop of wire around the object, then to the wire drive to tighten the loop of wire around the object, then to the spinner/cutter drive to rotate the spinner/cutter and form a wire knot by twisting the wire loop and to cut the wire.

26. The wire tying device of claim 25, wherein the wire drive comprises a device that includes driving means for driving wire in a first direction and then a second direction, said driving means comprising a capstan drum operatively coupled to circumferentially located pressure rollers, and further including means for wrapping wire around the capstan drum and holding it against the capstan durm using said circumferentially located pressure rollers.

27. A wire tying device, comprising:

(a) a housing, (b) a wire holder in wire feeding communication with the housing, (c) a wire drive operatively connected to the housing, the wire drive having an infeed opening and an outfeed opening, the wire drive including a capstan having a capstan drum for transporting a length of wire as the wire wraps around the drum, (d) a spinner drive operatively connected to the housing, the spinner drive having a spinner head opening, (d) a talon drive including a talon having a channel, and (e) a motor transmitting power to the wire drive, the spinner drive, and the talon drive, wherein, and responsive to the motor transmitting power, the length of wire is passed from the wire holder to the infeed opening, the outfeed opening, the spinner head opening, and the channel.

28. The device of claim 27, wherein the wire holder is a spool positively keyed to a shaft in the housing.

29. The device of claim 28, wherein the spool has a mechanism to prevent the wire from expanding off the spool.

30. The device of claim 27, wherein the capstan has a number of capstan rollers, each roller having a groove for transporting the length of wire.

31. The device of claim 30, wherein the grooves of the capstan rollers are progressively offset from one another such that the length of wire is progressively moved from groove to groove as the wire is transported through the capstan.

32. The device of claim 30, further comprising a capstan roller spring for urging a capstan roller against the drum.

33. The device of claim 27, wherein the spinner drive includes a wire sensor proximity switch triggered by an end of the length of wire.

34. The device of claim 33, wherein the spinner drive includes a tab for locking the length of wire in place.

35. The device of claim 27, wherein the talon drive includes a pair of talons, at least one of which is pivotable from a closed position to an open position.

36. The device of claim 35, wherein the pair of talons includes a set of opposed spring-loaded trap doors, the trap doors being urged by springs to open as a talon pivots to an open position.

37. The device of claim 27, wherein the motor is reversible.

38. The device of claim 37, wherein there is but a single motor.

39. The device of claim 27, further including a mechanical logic device for controlling at least one of the wire drive, the spinner drive, and the talon drive.

40. The device of claim 39, further including a plurality of mechanical logic devices for controlling a sequence of operations of at least two of the wire drive, the spinner drive, and the talon drive.

41. The device of claim 40, further including a plurality of mechanical logic devices for controlling a sequence of operations of all three of the wire drive, the spinner drive, and the talon drive.

42. The device of claim 27, wherein the length of wire includes a coated wire.

43. The device of claim 27, wherein the length of wire includes a treated wire.

44. A method of tying a wire knot around an object, comprising the steps of:

(a) closing a pair of talons around an object to be tied and enclosing a channel within said talons;

(b) driving a length of wire through a spinner/cutter assembly, then through said enclosed channel within the talons, and then back through the spinner/cutter assembly;

(c) opening the talons, thereby opening the enclosed channel within the talons, to release the object to be tied and the wire enclosed within the channel;

(d) pulling back on the loop to tighten it around the object; and (e) turning the spinner/cutter assembly, thereby kinking, cutting and twisting the wire so as to extrude a knot away from the joint while holding the loop under tension as the knot is being formed.

45. A talon assembly for use in a wire tying device, said talon assembly comprising:

(a) a first talon having a first enclosed channel therein, said first enclosed channel being selectively openable;

(b) a second talon having a second enclosed channel therein, said second enclosed channel being selectively openable;

(c) wherein said first and second talons selectively engage one another, bringing said first and second enclosed channels into contact.

46. A spinner/cutter assembly for use in a device for tying a wire knot around an object, said spinner/cutter assembly comprising:

(a) a cylindrical spinner barrel for twisting a wire knot about an object to be tied;

(b) means for rotating the spinner barrel;

(c) wherein a rotation of the spinner barrel moves the spinner barrel away from the object to be tied; and (d) means for cutting a wire from which the wire knot is formed as the spinner barrel rotates.

* * * * *